US006776017B2

(12) United States Patent
Herdman

(10) Patent No.: US 6,776,017 B2
(45) Date of Patent: Aug. 17, 2004

(54) ADAPTABLE RADIAL TUMBLER LOCK

(75) Inventor: Rodrick A. Herdman, West Chester, OH (US)

(73) Assignee: EZ Change Lock Company, LLC, Cincinnati, OH (US)

( * ) Notice: Subject to any disclaimer, the term of this patent is extended or adjusted under 35 U.S.C. 154(b) by 0 days.

(21) Appl. No.: 09/986,259

(22) Filed: Nov. 8, 2001

(65) Prior Publication Data

US 2003/0084692 A1 May 8, 2003

(51) Int. Cl.[7] ..... E05B 29/06; E05B 35/08

(52) U.S. Cl. ..... 70/338; 70/366; 70/383; 70/384; 70/386; 70/492; 70/495

(58) Field of Search ..... 70/382–385, 495, 70/492, 496, 358, 365, 366, 337, 338, 377, 386, 392, DIG. 21, DIG. 22, DIG. 75

(56) References Cited

U.S. PATENT DOCUMENTS

| | | | | |
|---|---|---|---|---|
| 688,070 | A | * | 12/1901 | Denn |
| 711,376 | A | * | 10/1902 | Bayer |
| 1,218,065 | A | * | 3/1917 | Diesel |
| 1,545,046 | A | * | 7/1925 | Epstein |
| 1,644,365 | A | * | 10/1927 | Bennett |
| 2,326,358 | A | | 8/1943 | Hull |
| 2,524,339 | A | * | 10/1950 | Young et al. |

(List continued on next page.)

FOREIGN PATENT DOCUMENTS

| | | | | |
|---|---|---|---|---|
| CA | 695186 | * | 9/1964 | 70/384 |
| DE | 911220 | * | 5/1954 | 70/366 |
| DE | 2062074 | * | 6/1972 | 70/366 |
| DE | 2517689 | * | 11/1975 | 70/366 |
| DE | 2646739 | * | 4/1978 | 70/384 |
| SE | 115282 | * | 10/1945 | 70/366 |

*Primary Examiner*—Lloyd A. Gall
(74) *Attorney, Agent, or Firm*—Hasse Guttag & Nesbitt; Daniel F. Nesbitt; Eric W. Guttag

(57) ABSTRACT

An adaptable lock 10 assembly and a method of using the lock 10 assembly in order to reprogram a lock 10 to accept a key different from the key which originally operated the lock 10. The lock 10 assembly includes a housing 12 with a bore 14 disposed through the housing 12 and a plug 16 rotatably mounted in the bore 14. The plug 16 includes at least one radial slot 18 which is disposed in the plug 16 along the circumference of the plug 16. The plug 16 further includes a longitudinal slot used as a keyway 22 which is adapted to receive a key. The assembly further includes first and second radial tumblers 30, 32 which are disposed in the radial slot 18 and are capable of being in an engaged or disengaged relationship. The distal ends of the first and second radial tumblers 30, 32 extend into the keyway 22 to provide a pattern of ridges along the longitudinal inner walls of the keyway 22. When the first and second radial tumblers 30, 32 are engaged in a first position, a first key 24 fits the lock 10. The first and second radial tumblers 30, 32 may be disengaged in order to reprogram the lock 10 to a second key 44.

29 Claims, 11 Drawing Sheets

U.S. PATENT DOCUMENTS

| | | | | | |
|---|---|---|---|---|---|
| 2,591,111 | A | * | 4/1952 | Willett et al. | |
| 2,648,972 | A | * | 8/1953 | Diesel | |
| 2,862,380 | A | * | 12/1958 | Welch | |
| 3,208,248 | A | * | 9/1965 | Tornoe | |
| 3,260,080 | A | * | 7/1966 | Wellekens | |
| 3,320,781 | A | | 5/1967 | Hill | |
| 3,589,153 | A | | 6/1971 | Hill | 70/384 |
| 3,667,262 | A | * | 6/1972 | Hill | 70/384 |
| 3,774,424 | A | * | 11/1973 | Ehrat | 70/383 |
| 3,999,413 | A | | 12/1976 | Raymond et al. | 70/377 X |
| 4,015,458 | A | | 4/1977 | Mercurio | 70/377 X |
| 4,069,694 | A | | 1/1978 | Raymond et al. | 70/337 |
| 4,083,212 | A | | 4/1978 | Proefrock | 70/366 |
| 4,195,503 | A | | 4/1980 | Roberts | 70/366 |
| 4,231,242 | A | | 11/1980 | Hill et al. | 70/347 |
| 4,336,701 | A | | 6/1982 | Raymond | 70/395 |
| 4,376,382 | A | | 3/1983 | Raymond et al. | 70/338 |
| 4,403,486 | A | | 9/1983 | Miyake | 70/383 |
| 4,407,147 | A | * | 10/1983 | Larson | 70/365 |
| 4,412,437 | A | | 11/1983 | Smith | 70/338 |
| 4,429,555 | A | * | 2/1984 | Salsbury | 70/366 |
| 4,651,546 | A | | 3/1987 | Evans | 70/366 |
| 4,712,399 | A | | 12/1987 | Mattossovich | 70/383 X |
| 4,723,427 | A | | 2/1988 | Oliver | 70/366 X |
| 4,729,231 | A | | 3/1988 | Wu | 70/383 |
| 4,741,188 | A | | 5/1988 | Smith | 70/383 |
| 4,747,281 | A | * | 5/1988 | Monahan | 70/383 |
| 4,836,002 | A | | 6/1989 | Monahan | 70/382 |
| 4,850,210 | A | | 7/1989 | Adler et al. | 70/383 |
| 4,912,953 | A | | 4/1990 | Wobig | 70/383 |
| 4,966,021 | A | | 10/1990 | Boag | 70/383 |
| 5,233,850 | A | | 8/1993 | Schroeder | 70/337 |
| 5,613,389 | A | | 3/1997 | Hauser | 70/366 |
| 5,791,181 | A | * | 8/1998 | Sperber et al. | 70/383 |
| 5,799,519 | A | | 9/1998 | Hsiao | 70/358 |
| 5,826,451 | A | | 10/1998 | Cook | 70/495 |
| 6,119,495 | A | | 9/2000 | Loreti | 70/340 |
| 6,425,274 | B1 | | 7/2002 | Laitala et al. | 70/394 |

* cited by examiner

ADAPTABLE RADIAL TUMBLER LOCK

FIELD OF INVENTION

This invention relates generally to cylinder locks, and more particularly to a programable cylinder lock which allows for adapting the lock to operate upon insertion of a key having a different configuration than a key to which the lock was originally adapted.

BACKGROUND OF THE INVENTION

In many organizations, such as businesses, apartment buildings, hotels, etc., it is generally desirable to customize the locks to the particular organization. There are two general methods by which keys and locks may be customized. A first method involves reconfiguring the drivers and tumblers in the lock so that a key with a particular top edge contour may operate the locks of the organization. The second method is by configuring the keyways in the locks to accept keys having a unique pattern of longitudinal contours formed in their sides. The purpose of the exclusivity generated by these methods is to prevent unauthorized entry into the organization. By this second method, it is not sufficient for opening the lock that one have a key having a top edge contour appropriate to the lock; the key must also include an appropriate longitudinal contour of grooves and/or ridges.

In general, standard locks include a housing which has a cylindrical bore therein. An elongated plug is rotatably mounted in the bore. A plurality of apertures extend through the housing and into the plug. A number of drivers and tumblers are positioned in these apertures and capable of being positioned in the plug and housing in such a manner as to allow for rotational movement of the plug in response to a main key inserted in the lock. The arrangement and construction of the lock provides for the drivers and/or tumblers to be positioned in the apertures between the plug and housing to prevent relative rotation between the plug and the housing when the wrong main key or no main key is inserted in the lock. However, the relative positioning of the drivers, tumblers, plug, and housing is such that, when the proper key is inserted, the drivers are positioned in the apertures substantially wholly within the housing and the tumblers are positioned in the apertures substantially wholly within the plug such that the plug can be rotated to an unlocking position. Many locks or sets of locks also include two types of keys: tenant keys and master keys. In general, each tenant key will only open one lock of a particular subset of locks, whereas a master key may open all the locks of the subset.

Over the course of time, the security of an organization may become compromised by the loss of control of one or more of the keys. For example, in apartment buildings, hotels, or motels, a guest or renter may leave and inadvertently or intentionally retain a key. When this occurs, subsequent occupants or tenants cannot be secure in their persons and property. Thus it would be desirable to easily and quickly reprogram the locks to accept a new key or set of keys. Locks that can be easily changed are also desired by businesses where several employees are in possession of keys to fit the locks. In such situations, an employee may be discharged or quit, but retain possession of a key. Further, an employee may lose a key, thus placing the security of the locked area in doubt.

When keys are lost or are possessed adversely, the general response is to change the locks fitting the lost key to require a key with a new top edge contour to correspond to different length tumblers. Generally, the shape of the longitudinal inner walls of the keyway which confronts the longitudinal contour on the side of the key is not changed due to the generally exorbitant cost of such a change.

The excessive expense of changing the pattern of the longitudinal walls of the keyway arises from the structure of the locks themselves. In general, as described above, locks designed for exclusive use by one organization include a plug rotatable within a lock housing for unlocking doors, etc. The key is inserted into a slot, or keyway, extending longitudinally into the plug and rotated to rotate the plug. Locks have generally been customized for a particular key blank by forming a set of ridges on the portions of the plug forming the walls of the keyway, the ridges extending parallel to the longitudinal axis of the keyway. The key blanks are provided with a corresponding set of grooves so that the ridges and grooves will mesh when the proper key is inserted into the keyway. If the key includes an improper pattern of longitudinal contours, the contour of the keyway will obstruct the key from being inserted.

Thus, in order to change the contour of the longitudinal inner walls of the keyway, it would be necessary to alter the plug in the lock. Since it is not economically feasible to add ridges within the narrow confines of a keyway, it is difficult to change the plug to prevent insertion of a key for which the plug and keyway were originally manufactured.

Previous attempts to correct the problems and drawbacks with replacing key blanks and redesigning the configuration of keyways in plugs have involved such methods as providing a set of bores which extend parallel to the longitudinal axis of the keyway and pins which slide in and out of the keyway with the end of the pins protruding into the pathway of the keyway. By removing and replacing and/or adding additional pins into the bores, the configuration of the wall of the keyway and thus the proper key to be inserted may be changed. However, this method requires removing and inserting the pins, which is a tedious and time consuming task.

Thus, it would be desirable to provide and construct a lock which permits rapid change the positioning of tumblers to accept a key of a different design. It would further be desirable to construct a lock to permit inexpensive change of keyway and key design. It would further be desirable to provide a lock which allows the operative key to be changed without removal of the plug from the lock, and/or other disassembly of the lock structure.

SUMMARY OF THE INVENTION

The present invention solves the problems and eliminates the drawbacks of locks as described in the background of the invention. The present invention does so by providing both an adaptable lock and a method of using the lock in order to reprogram the lock to accept a second key having a longitudinal contour different from a first key which originally operated the lock. This longitudinal contour may include ridges and/or grooves.

The lock includes a housing with a bore disposed through the housing and a plug rotatably mounted in the bore. This plug includes at least one first groove, referred to as a radial slot, disposed concentrically about and radially outwardly from the longitudinal axis of the plug. The plug further includes a first orifice, which may be a longitudinal slot used as a keyway, which is adapted to receive a key. The lock further includes first and second radial tumblers which are disposed in the radial slot. These first and second radial tumblers may be engaged with one another or disengaged from one another.

In one embodiment of the present invention, the engagement or disengagement of the first and second radial tumblers may be provided by the positioning of a retainer. When this retainer contacts the first radial tumbler, it moves the first radial tumbler into engagement with the second radial tumbler. When the retainer does not contact the first radial tumbler, the first and second radial tumblers disengage. When engaged, the first and second radial tumblers move cooperatively with one another. When disengaged, the second radial tumbler can move independently of the first radial tumbler. The distal ends of the first and second radial tumblers extend into the keyway and contact and engage the pattern created by the longitudinal contour of the key. An operator may move the retainer in and out of engagement with the first radial tumbler by inserting a reset tool into a second orifice, referred to as a reset slot, which intersects a cavity housing the retainer. This action lifts the retainer away from and out of engagement with the first radial tumbler, thus allowing the second radial tumbler to move independently of the first radial tumbler.

The method of using the lock of the present invention involves inserting a first key to which the lock is programmed to operate into the longitudinal keyway of the lock. The first and second radial tumblers are then disengaged one from another. The first key is then removed from the longitudinal slot and the second radial tumbler, now disengaged from the first radial tumbler, moves freely and independently of the first radial tumbler. The second key, having a different longitudinal contour than the first key, is then inserted into the reset slot. As this happens, the second radial tumbler moves to match the longitudinal contour of the second key. The first and second radial tumblers are then engaged with one another, thus placing them in a configuration adapted to the longitudinal contour of the second key.

Alternate embodiments of the invention may include multiple pairs of radial tumblers, each pair disposed in one of multiple radial slots disposed in the plug.

The method of reconfiguring the lock of the present invention as described above can be used to reconfigure the radial tumblers in order to change tenant keys which can properly operate the lock. Yet another embodiment of the present invention allows for changing the master keys which can properly operate the lock. In particular, this alternate embodiment allows for changing the configuration of the lock to accept a second master key having a different longitudinal contour than a first master key. In one such embodiment, a second set of radial tumblers, or a second set of multiple pairs of radial tumblers are disposed in a master radial slot or master radial slots located along the side of the plug opposite the radial tumblers used to program the lock for a tenant key.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
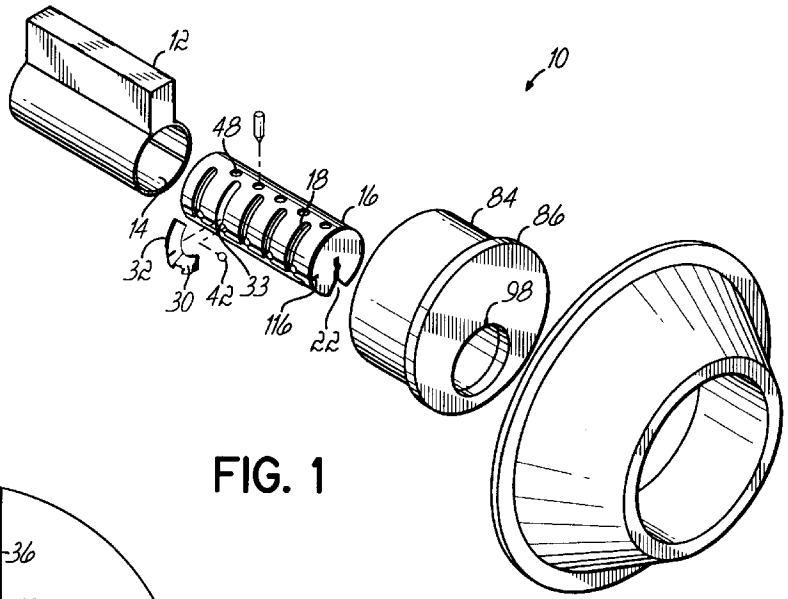
FIG. 1 is a perspective, disassembled view of the components of the lock assembly of the present invention.
Figure 10:
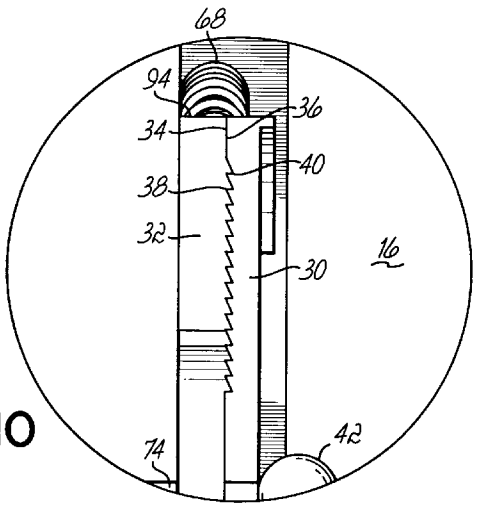
FIG. 10 is an enlarged view of the interaction between retainer and first and second radial tumblers encircled in FIG. 2A as No. 10.
Figure 9:
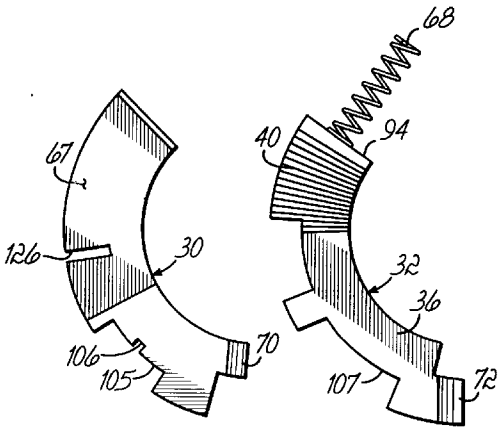
FIG. 9 is a perspective view of the first and second radial tumblers in accordance with the principles of the present invention.

The present invention reduces the problems and eliminates the drawbacks as discussed above in the background of the invention. Referring to the Figures, in the illustrated embodiment the present invention does so by providing an adaptable lock 10 which includes a housing 12 having a bore 14 therein and a plug 16 rotatably mounted in the bore 14 of the housing 12. This plug 16 includes at least one first groove in the form of a radial slot 18 disposed in the circumference of the plug 16 circumferentially about and radially outwardly from the longitudinal axis 20 of the plug 16. This radial slot 18 forms a cavity through and within the outer periphery of the plug 16. The plug 16 further includes a first orifice which may be in the form of a longitudinal slot, referred to as a keyway 22, adapted to receive a first key 24. This keyway 22 allows for the insertion of a first key 24 having a longitudinal contour 26 of grooves and/or ridges and a top edge contour 28. A first radial tumbler 30 and second radial tumbler 32 may be disposed in the radial slot 18, each of the first and second radial tumblers 30, 32 including distal ends 70, 72, respectively, which extend into the keyway 22. The first and second radial tumblers 30, 32 include sides 34, 36 capable of being placed in confronting engagement with one another. The confronting sides axially adjacent faces of the first and second radial tumblers 30, 32 include a series of teeth 38, 40 which are capable of meshing to facilitate the engagement of the first and second radial tumblers 30, 32. A retainer 42 is also provided in a cavity 33 disposed in the plug 16 directly adjacent to and continuous with the radial slot 18. This retainer 42 is adapted to contact and confront the first radial tumbler 30. When the retainer 42 contacts the first radial tumbler 30, the first and second radial tumblers 30, 32 are held in engagement such that they cannot move relative to one another, but rather, move cooperatively. When the retainer 42 is not in contact with the first radial tumbler 30, the first and second radial tumblers 30, 32 disengage such that they can be moved relative to one another. This allows the repositioning of the first and second radial tumblers 30, 32 relative to one another to alter the configuration of distal ends 70, 72 protruding into the keyway 22. Thus, once the first and second radial tumblers 30, 32 are repositioned and re-engaged, the lock 10 will now accept a second key 44 having a different longitudinal contour 46 than the first key 24.

In general, the lock 10 includes housing 12 with bore 14 through the housing 12 for receiving plug 16. The housing 12 and plug 16 of the lock 10 include vertical apertures 48 within which drivers 50 and tumblers 52 are disposed. The tumblers 52 are positioned in the vertical apertures 48 such that they extend into the keyway 22 of the plug 16. The drivers 50 rest in the vertical apertures 48 atop the tumblers 52. A driver spring 54, located within each vertical aperture 48 between the top of the housing 12 and the driver 50, biases the drivers 50 and tumblers 52 in a downward fashion such that the tumblers 52 project into the keyway 22 of the plug 16 when no key is inserted.

When a first key 24 is inserted into the keyway 22, the tumblers 52 and drivers 50 are raised consistent with the top edge contour 28 of the key. If the proper key has been inserted, the confronting lower end 56 of the driver 50 and upper end 58 of the tumbler 52 will be disposed along the shear line 60 of the lock 10. The shear line 60 is located where the outer circumference of the plug 16 confronts the surface of the bore 14. Thus, the proper key will raise the respective tumblers 52 and drivers 50 to allow for rotation of the plug 16 within the housing 12 of the lock 10. As the plug 16 rotates, the drivers 50 will be disposed substantially wholly within the housing 12 in a first portion 62 of the apertures 48, and the tumblers 52 will be disposed substantially wholly within the plug 16 in a second portion 64 of the apertures 48. The first key 24 includes a first longitudinal contour 26 disposed at least along one side of the key and a top edge contour 28. Alternatively, the longitudinal contour may be disposed on both sides of the key 24.

More specifically, and with particular reference to FIG. 1, the body 84 of the lock 10, of the illustrated embodiment, is generally cylindrical in configuration and is provided with a flange 86 at one end to abut a door or other member in which the lock 10 may be installed. A portion of the body 84 may be threaded (not shown) near the opposite end to permit the lock 10 to be secured to an object requiring locking. The bore 14 is formed in the housing 12 of the lock 10 and extends through the housing 12 about a longitudinal axis and intersects both ends of the housing 12. The plug 16 of the illustrated embodiment includes a cylindrical body configured such that in the assembled lock 10, the periphery of the plug 16 confronts the surface of the bore 14 of the lock 10, with the longitudinal axes of the bore 14 and plug 16 being substantially coaxial. A latch member (not shown) may be secured on the other end of the plug 16 to engage a recess (not shown) to lock the object in which the lock 10 is installed.

Figure 2B:
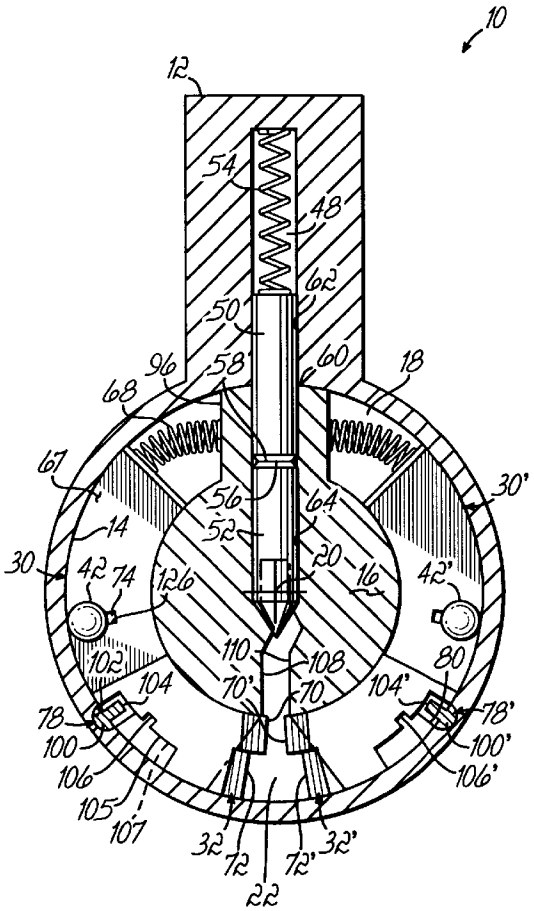
FIG. 2B is a cross-sectional view taken along line 2B—2B of FIG. 2A.
Figure 2A:
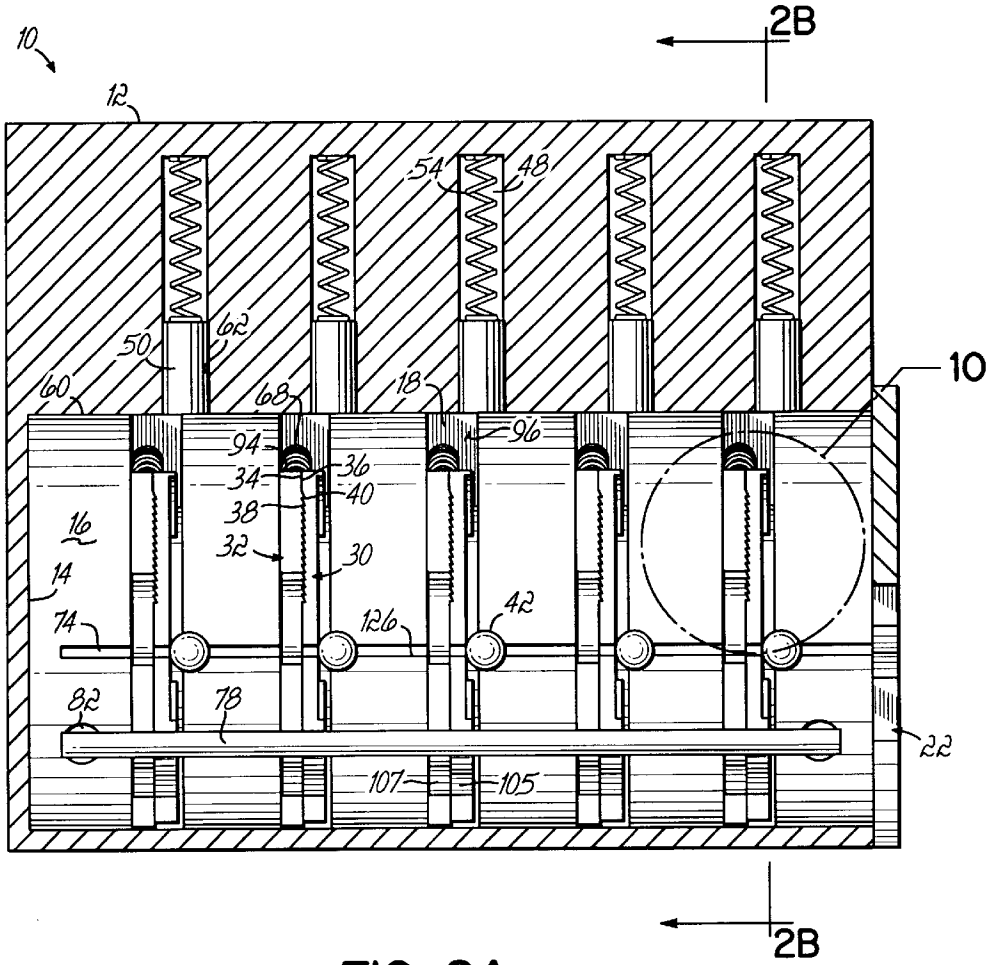
FIG. 2A is a cross-sectional view of the plug of the lock assembly of the present invention depicting a series of radial tumblers and retainers in accordance with the principles of the present invention.

Referring now to FIGS. 1, 2A, and 2B, in the illustrated embodiment of the present invention the vertical apertures 48 extend in a manner substantially orthogonal with respect to the longitudinal axis 20 of the plug 16. The vertical apertures 48 extend through a portion of the plug 16 to intersect the bore 14 and extend further into the housing 12 of the lock 10. Thus, the first portion 62 of each vertical aperture 48 intersects the housing 12 and the bore 14, and the second portion 64 of each vertical aperture 48 intersects the periphery of the plug 16 and the keyway 22. Driver 50 is disposed at least within each first portion 62, and includes a driver spring 54 between the top of each vertical aperture 48 and each driver 50 to urge the driver 50 generally toward the bore 14. When no key is inserted into the keyway 22, the force of the driver spring 54 causes at least a portion of each driver 50 to project into the second portion 64 of each vertical aperture 48.

Each second portion 64 is axially aligned with a respective first portion 62 of each vertical aperture 48 when the plug 16 has not been rotated. The tumbler 52 is disposed within the second portion 64 of each vertical aperture 48 and portions of each tumbler 52 extend into the keyway 22 due to the force of the driver 50 and driver spring 54. Additionally, the upper end 58 of each tumbler 52 thus contacts and confronts the lower end 56 of each driver 50. It will be apparent to those of skill in the art that while the illustrated embodiment of the lock 10 of the present invention is depicted as having a particular plurality of drivers and tumblers, alternate embodiments of the lock may include one pair of driver and tumbler, or multiple pairs of drivers and tumblers of lesser or greater number than that depicted in the illustrated embodiment.

Referring to FIGS. 2A, 2B, 9, 10, 12A, and 12B, a first radial tumbler 30 and a second radial tumbler 32 may be located in a radial slot 18 which is disposed in the circumference of the plug 16 along the longitudinal axis of the plug 16. These first and second radial tumblers 30, 32 may be disposed movably within the radial slot 18 in the plug 16 in a manner concentric about the longitudinal axis 20 of the plug 16. The first and second radial tumblers 30, 32 are biased toward the keyway 22 of the plug 16 by a radial tumbler spring 68. As a result, the distal ends 70, 72 of the first and second radial tumblers 30, 32 project into the keyway 22, thereby forming a pattern of distal ends 70, 72 within the keyway 22. Thus, not only must the top edge contour 28 of the key 24 be of correct shape to raise the drivers 50 and tumblers 52 to match the shear line 60 of the lock 10, but the longitudinal contour 26 on the first key 24 must be such as to allow the key 24 to mesh with distal ends 70, 72 of the first and second radial tumblers 30, 32 which extend into the keyway 22 of the plug 16 in such a configuration as to allow the plug 16 to be rotated.

In the illustrated embodiment of the present invention, a plurality of pairs of radial tumblers 30, 32 are disposed within radial slots 18 in the sidewall of the plug 16. Each pair includes a first radial tumbler 30 and a second radial tumbler 32. For purposes of the disclosure, only one pair of first and second radial tumblers 30, 32 will be described although it will be apparent to those skilled in the art that while the lock 10 of the present invention would operate with one pair of first and second radial tumblers 30, 32, alternatively, multiple pairs may be provided along one side of the plug 16. Additionally, only one pair of first and second radial tumblers 30, 32 is depicted in the disassembled view of FIG. 1 although it will be apparent to those skilled in the art that multiple pairs may be provided. Also, alternatively, and as shown in the illustrated embodiment, a secondary pair or pairs of first and second radial tumblers 30', 32' may be provided on the opposite side of the plug 16 such that the distal ends 70, 72, 70', 72' of the radial tumblers 30, 32, 30', 32' project into each side of the keyway 22.

Referring now to FIGS. 1, 2A, 2B, 9, 10, 12A, and 12B, the first and second radial tumblers 30, 32 are capable of being held in confronting and engaging relationship with one another by a series of first teeth 38 disposed on a side 34 of the first radial tumbler 30 and a matching series of second teeth 40 on a side 36 of the second radial tumbler 32. These series of first and second teeth 38, 40 are adapted to mesh with one another so that the first and second radial tumblers 30, 32 move cooperatively with one another when engaged. When these teeth 38, 40 are disengaged one from another, the first and second radial tumblers 30, 32 may move independently of one another.

The retainer 42, of the illustrated embodiment, may be adapted to interact with the first radial tumbler 30 in order to cause the first and second radial tumblers 30, 32 to engage and/or disengage depending on the positioning of the retainer 42. In an alternate embodiment, the retainer 42 may be adapted to confront the second radial tumbler 32. The retainer 42 may be adapted to be movably disposed in a cavity and to be positioned adjacent to the first radial tumbler 30 in the illustrated embodiment. When the retainer 42 is disposed in a first position (as shown in FIG. 2A), it contacts a side 67 of the first radial tumbler 30 opposite the series of first teeth 38. When the retainer 42 is in the first position, it also confronts the distal wall of the cavity. Thus, as the retainer 42 is placed in the first position, it forces the first radial tumbler 30 to move in a direction substantially parallel to the longitudinal axis 20 of the plug 16 and toward the second radial tumbler 32 to contact and confront the second radial tumbler 32 such that the series of first and second teeth 38, 40 of the first and second radial tumblers 30, 32 engage.

The retainer 42 may be moved from the first position to a second position in order to allow the first and second radial tumblers 30, 32 to disengage as will be described more fully below. As the first and second radial tumblers 30, 32 are disengaged, the second radial tumbler 32 can be moved relative to the first radial tumbler 30. Thus, when the retainer 42 is moved from the second position back to the first position, the first and second radial tumblers 30, 32 may re-engage one another in a different configuration or relationship as compared to their original engaged position. In the lock of the illustrated embodiments, this allows the extent to which the distal end 72 of the second radial tumbler 32 protrudes into the keyway 22 to be altered, thereby necessitating a second key 44, having a different longitudinal contour 46 than the first key 24, to open the lock 10.

It will be appreciated by those of skill in the art that the first and second radial tumblers 30, 32 can be reconfigured relative to one another in any number of ways dependent on the number of teeth 38, 40 of the radial tumblers 30, 32. For example, in one embodiment, the radial tumblers may be reconfigured in five different positions. Alternate embodiments of the invention may include greater than or less than five positions. In the particular illustrated embodiment, the first radial tumbler 30 is held in a constant position and the second radial tumbler 32 is repositioned relative to the first radial tumbler 30. Thus, the extent to which the distal end 70 of the first radial tumbler 30 protrudes into the keyway 22 does not change. In alternate embodiments, both the first and second radial tumblers 30, 32 may be repositioned.

A radial tumbler spring 68 is disposed in confronting relationship with the second radial tumbler 32 between the top edge 94 of the second radial tumbler 32 and the upper sidewall 96 of the plug 16. When the first and second radial tumblers 30, 32 are engaged, this spring 68 biases the first and second radial tumblers 30, 32 away from the upper sidewall 96 and toward the keyway 22, such that the distal ends 70, 72 of the first and second radial tumblers 30, 32 project into the keyway 22 of the plug 16. The distal ends 70, 72 of the first and second radial tumblers 30, 32, in the illustrated embodiment, are beveled such that a key being inserted into the keyway 22 may move past the first and second radial tumblers 30, 32. When the first and second radial tumblers are disengaged, the radial tumbler spring 68 biases the second radial tumbler 32 toward the keyway 22 so that it may be repositioned with respect to the first radial tumbler 30.

The plug 16, in the illustrated embodiments of the lock 10 of the present invention, also includes a second orifice in the form of a reset slot 74 which, in the illustrated embodiment, extends along a plane substantially parallel to the longitudinal axis of the plug 16 and intersects each radial slot 18. This reset slot 74 provides for the insertion of a reset tool 76 to displace the retainer 42, which confronts the first radial tumbler 30. Upon insertion of the reset tool 76, the retainer 42 is displaced from a first position to a second position.

As described above, the reset slot 74 is disposed through the periphery of the plug 16 for the insertion of the reset tool 76 which causes the retainer 42 to move from a first position to a second position. The retainer 42, in the illustrated embodiment, is shown as a ball bearing. However, it will be apparent to those skilled in the art that other objects may be amenable to use as a retainer 42. As the reset tool 76 is inserted into the reset slot 74, it contacts the retainer 42 and forces it to move away from the first radial tumbler 30, thus allowing the first and second radial tumblers 30, 32 to disengage. As can be seen from the Figures, and as will be appreciated by those of skill in the art, the retainer 42 also operates as a "gate" to prevent the insertion of the reset tool 76 by blocking the reset slot 74, unless the plug 16 has been rotated to the proper position to allow the movement of the retainer 42 from the first position to the second position. The housing 12 and the plug 16 of the lock 10 each include an indicia mark to be used in conjunction with the reset tool 76 in reprogramming the lock 10, as will be discussed more fully below in describing the use of the lock 10.

The lock 10 further includes a sidebar 78 which is disposed in a longitudinal sidebar slot 80. Both the sidebar 78 and sidebar slot 80 extend along a plane substantially parallel to the longitudinal axis 20 of the plug 16. At least one sidebar spring 82 is contained within the housing 12 and confronts the sidebar 78 in order to bias the sidebar 78 radially outwardly from the longitudinal axis 20 of the plug 16.

The sidebar 78, of the illustrated embodiment, extends substantially the length of the plug 16 and includes a projection 100 on a first side thereof. The projection 100 is adapted to mate with a second groove 102 which is disposed in the housing 12 of the lock 10. As described above, the plug 16 of the housing 12 further includes the sidebar slot 80 disposed in the periphery of the plug 16 in order to house the sidebar 78. At least one lug 104 extends from a second side of the sidebar 78 toward the first and second radial tumblers 30, 32. The lug 104, in the illustrated embodiment, is disposed substantially opposite from the projection 100. The sidebar spring 82 biases the sidebar 78 away from the first and second radial tumblers 30, 32 in such manner that the projection 100 of the sidebar 78 may be disposed within the second groove 102 when the plug 16 is not being rotated. In the illustrated embodiment, two sidebar springs 82 are used to bias the sidebar 78.

As can be seen in the illustrated embodiment, the first and second radial tumblers 30, 32 further include sidebar grooves 105, 107 respectively, which allow for movement of the radial tumblers 30, 32 even while the sidebar 78 is held in position with projection 100 in the second groove 102. The sidebar groove 105 in the first radial tumbler 30 is only of a depth sufficient to house the length of the sidebar 78 when the projection 100 is disposed in the second groove 102. The first radial tumbler 30 further includes a sidebar notch 106 which extends from the sidebar groove 105 in a direction orthogonal to and substantially toward the longitudinal axis 20 of the plug 16. The sidebar groove 107 of the second radial tumbler 32 is of the depth equal to that of the sidebar notch 106 of the first radial tumbler 30.

With no key or an improper key inserted in the keyway 22, the radial tumblers 30, 32 will be disposed within the radial slot 18 such that the sidebar 78 will not be aligned over the sidebar notch 106. Thus, any attempted rotation of the plug 16 will be prevented by the location of the projection 100 in the second groove 102 of the housing 12 (FIG. 2B). When a proper key 24 is inserted in the keyway 22, the sidebar lug 104 will be aligned with the sidebar notch 106 which will allow displacement of the sidebar 78 out of the second groove 102 and into the sidebar notch 106 upon rotation of the plug 16 (See, for example, FIGS. 3A–4B).

Referring now to FIGS. 3A, 3B, 4A, 4B, 12A, and 12B, at the time of insertion of a proper first key 24 and prior to the turning of the plug 16, each of the tumblers 52 and drivers 50 will be lifted by the top edge contour 28 of the key 24 such that the contact point between the drivers 50 and the tumblers 52 is substantially within the same plane as the shear line 60 of the lock 10. Also, for the first key 24 to be inserted such that the plug 16 may be rotated, the key 24 must have a longitudinal contour 26 which matches the pattern of the keyway 22 formed by the distal ends 70, 72 of the first and second radial tumblers 30, 32. Such a key 24 may operate a lock having radial tumblers on one side of the plug. It will be noted, in the illustrated embodiment, that a proper key may also match radial tumblers 30', 32'. However, for present purposes, only one set of radial tumblers 30, 32 will be discussed in order to disclose the principles of the present invention.

As the proper first key 24 is inserted, the radial tumblers 30, 32 will move circumferentially about the longitudinal axis 20 of the plug 16 such that the lug 104 of the sidebar 78 is positioned in alignment with a sidebar notch 106 disposed in the first radial tumbler 30. The sidebar lug 104 then has suitable space for movement toward the radial tumblers 30, 32 upon turning of the first key 24. When the key 24 is turned, the sidebar projection 100 cams out of the groove 102 and the sidebar 78 moves inwardly to a position wherein the lug 104 of the sidebar 78 is accommodated by the sidebar notch 106 in the first radial tumbler 30 and the sidebar groove 107 in the second radial tumbler 32.

With a proper first key 24 inserted in the lock 10 and the above described disposition of the drivers 50 and tumblers 52, the plug 16 may be rotated to disengage the latch member (not shown) from the door jamb slot or other recess so that the door or other member may be opened. If the top edge contour 28 is inappropriate to the lock 10, portions of one or more of the drivers 50 will in general project into the second portions 64 of the vertical apertures 48, and/or portions of one or more of the tumblers 52 will, in general, project into the first portions 62 of the vertical apertures 48 to fix the plug 16 at the locking orientation so that the door or other member in which the lock 10 is installed cannot be opened. Additionally, a key, even a key with a proper top edge contour, will be unable to operate the lock 10 if the key does not have a preselected design of the longitudinal contour 26 running along its length to match the contour of the keyway 22 provided by the distal ends 70, 72 of the first and second radial tumblers 30, 32 projecting into the keyway 22. Such a proper longitudinal contour 26 facilitates the alignment of sidebar lug 104 with sidebar notch 106.

With reference to the Figures, the keyway 22 in the plug 16 is substantially rectangular in shape, and intersects a portion of the periphery of the plug 16. The limits of the keyway 22 are formed by a first internal side wall 108 and a second internal sidewall 110 of the plug 16. As described above, the distal ends 70, 72 of the first and second radial tumblers 30, 32 extend into and through at least one of the first and second internal sidewalls 108, 110 of the keyway 22. These distal ends 70, 72 project a preselected distance into the keyway 22. In alternate embodiments, distal ends of multiple pairs of first and second radial tumblers may project through both the first and second internal sidewalls.

Figure 18:
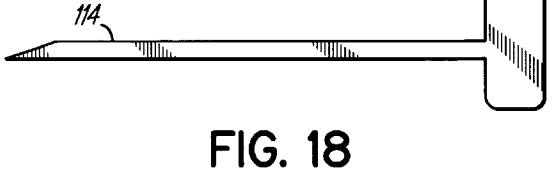
FIG. 18 is a perspective view of a reset tool in accordance with the principles of the present invention.

In order to manipulate the lock 10 such that it may be reprogrammed to alter the keyway 22 to accept different keys, a reset tool 76 is provided for insertion into the longitudinal reset slot 74. The reset tool 76, suitably configured for use with the lock 10 as described includes a handle portion 112 and a blade portion 114 (see FIG. 18). The blade portion 114 of the illustrated embodiment includes a beveled edge to facilitate movement of the blade portion 114 past the retainers 42. With this reset tool 76, the mechanism of the lock 10 can be readily changed to facilitate operation of the lock 10 with a different second key 44. In general, the insertion of the reset tool 76 into the reset slot 74 displaces the retainer 42 from a first position to a second position. This causes the first and second radial tumblers 30, 32 to disengage from one another such that the second radial tumbler 32 can be repositioned relative to the first radial tumbler 30.

Figure 11B:
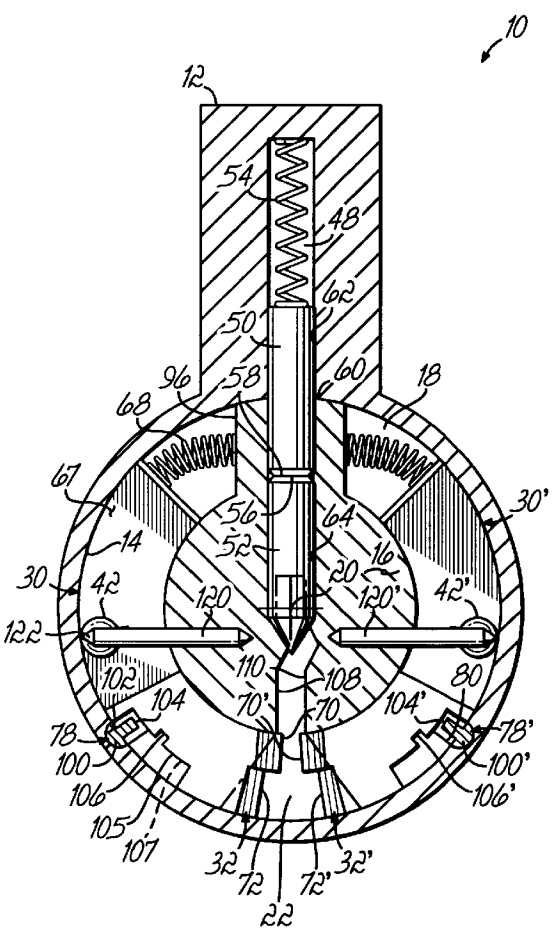
FIG. 11B is a cross-sectional view taken along line 11B—11B of FIG. 11A.
Figure 11A:
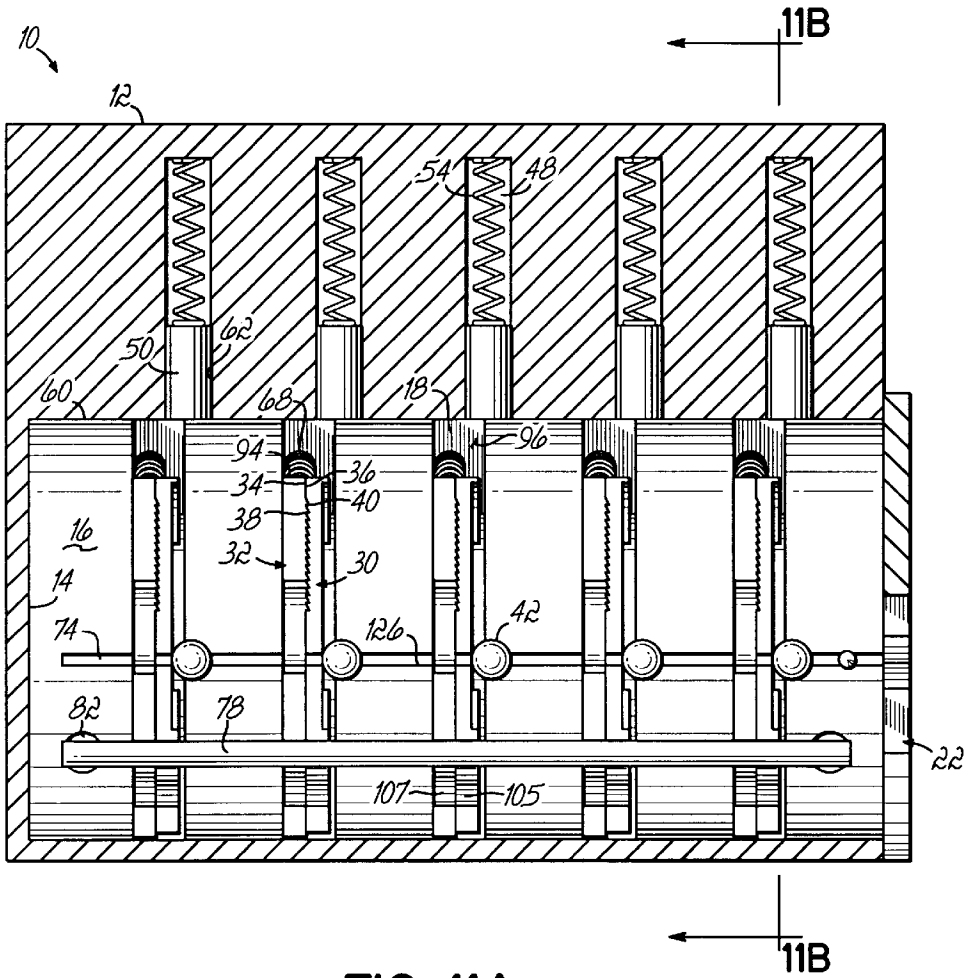
FIG. 11A is a cross-sectional view of the plug of the lock assembly of the present invention depicting a series of radial tumblers and retainers and an anti-tamper pin in accordance with the principles of the present invention.
Figure 13C:
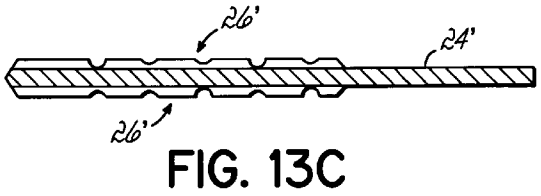
FIG. 13C is a cross-sectional view of the first tenant change key taken along line 13C—13C of FIG. 13A.
Figure 13B:
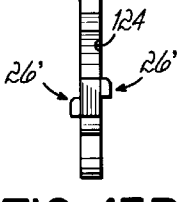
FIG. 13B is an end view of the first tenant change key of FIG. 13A.
Figure 13A:
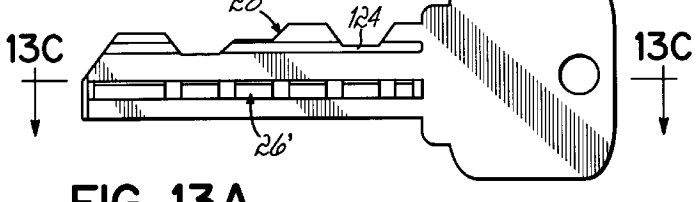
FIG. 13A is a perspective side view of a tenant change key to operate the lock assembly of the present invention depicting a longitudinal contour to correspond to the radial tumblers of the lock assembly of the present invention and also depicting an anti-tamper groove.
Figure 14C:
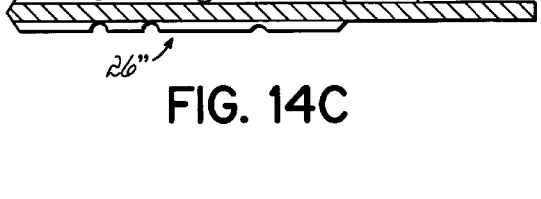
FIG. 14C is a cross-sectional view of the first master change key taken along line 14C—14C of FIG. 14A.
Figure 14B:
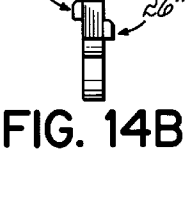
FIG. 14B is an end view of the first master change key of FIG. 14A.
Figure 14A:
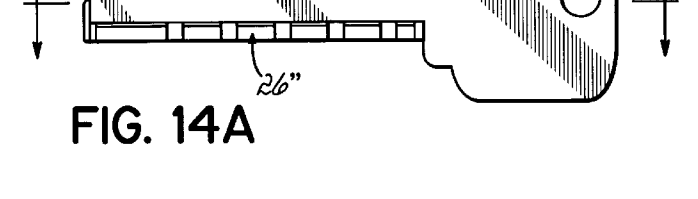
FIG. 14A is a perspective side view of a first master change key to operate the lock assembly of the present invention depicting a longitudinal contour to correspond to the radial tumblers of the lock assembly of the present invention and also depicting an anti-tamper groove.
Figure 15C:
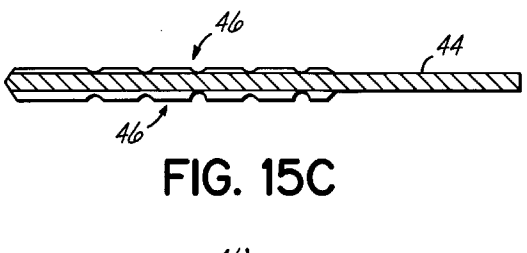
FIG. 15C is a cross-sectional view of the second key taken along line 15C, 15C of FIG. 15A.
Figure 15B:
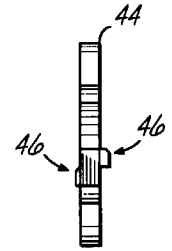
FIG. 15B is an end view of the second key of FIG. 15A.
Figure 15A:
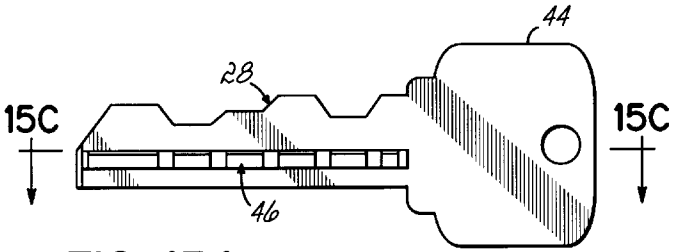
FIG. 15A is a perspective side view of a second key to operate the lock assembly of the present invention depicting a longitudinal contour to reset the radial tumblers of the lock assembly of the present invention.

In an alternate embodiment of the present invention depicted in FIGS. 11A and 11B, the lock 10 includes an anti-tamper pin 120 which rests in an orifice in the plug 16 in a first position such that a first end 122 of the anti-tamper pin 120 blocks the longitudinal reset slot 74 such that the reset tool 76, or any other object, cannot be fully inserted. With a proper first key 24' inserted, including an anti-tamper groove 124 (see FIGS. 13A–13C), and the plug 16 rotated to the correct second position, the reset tool 76 may be inserted into the reset slot 74, to move the anti-tamper pin 120 to a second position which does not impede the insertion of the reset tool 76. This will be described in greater detail in the method to reset the radial tumblers 30, 32 of the lock.

With reference to FIGS. 2A–8B, 12A–12C, 15A–15C, and 18, to reprogram the lock 10, the first key 24, which is the proper key to originally operate the lock 10, is inserted into the keyway 22, and the plug 16 is rotated relative to the housing 12 until an indicator mark 116 on the face of the plug 16 is aligned with an indicator mark 98 on the face of the housing 12. Lining up the indicator marks 98, 116 ensures that the retainers 42 are disposed along the vertical axis of the vertical apertures 48. The reset tool 76 is then inserted into the reset slot 74. As the reset tool 76 is inserted into the reset slot 74, each retainer 42 is displaced from a first position to a second position away from the first radial tumbler 30 and into vertical apertures 48 in the housing 12 of the lock 10 above the plug 16. As this happens, the first radial tumbler 30 disengages from the second radial tumbler 32 such that the second radial tumbler 32 may move independently of the first radial tumbler 30. In the illustrated embodiment of the present invention, the first radial tumbler 30 is held in a fixed position relative to the plug 16 due to a capture notch 126 disposed in the first radial tumbler 30. When the proper key 24 is inserted in the keyway 22, the capture notch 126 is aligned with the reset slot 74. Thus, when the reset tool 76 is inserted, it passes through the capture notch 126, thereby holding the first radial tumbler 30 in a fixed location as the second radial tumbler 32 moves relative to the first radial tumbler 30. The plug 16 is then rotated back to the starting position and the first key 24 removed from the keyway 22. As this happens, the radial tumbler spring 68 forces the second tumbler 32 toward the keyway 22 while the first radial tumbler 30 is captured.

Next, a second key 44 is inserted into the keyway 22. With the reset tool 76 inserted in the release slot 74 and the retainer 42 lifted away from the first and second radial tumblers 30, 32, the second radial tumbler 32 will move independently along the longitudinal contour 46 of the second key 44. Once the second key 44 is fully inserted, the plug 16 is rotated relative to the body 84 until the indicator marks 116, 98 in the plug 16 and housing 12 are once again aligned. At this point, the reset tool 76 is removed from the reset slot 74, and the retainer 42 is forced down into confronting relationship with the first radial tumbler 30 due to the spring driven force of the driver 50. This once again locks the first and second radial tumblers 30, 32 together in a manner which conforms to the longitudinal contour 46 of the second key 44. When the plug 16 is rotated back to its originating position and second key 44 removed, the second key 44 will now operate the lock 10, but the first key 24 will not.

More specifically, and with reference to FIGS. 2A–8B, 9, 10, 12A–12C, 15A–15C, and 18, in use the lock 10 of the illustrated embodiment of the present invention which accepts a first key 24 may be reprogrammed to accept a second key 44 as follows. With particular reference to FIGS. 2A and 2B, the lock 10 of the present invention is shown with the retaining member 42 contacting and confronting the first radial tumbler 30, and the first and second radial tumblers 30, 32 being held in engagement with one another. This engagement is caused by the meshing of the series of first and second teeth 38, 40. The distal ends 70, 72 of both the first and second radial tumblers 30, 32 thus project into the keyway 22 in a first predetermined position to accept a first key 24 having longitudinal contour 26 which matches the pattern defined by the distal ends 70, 72 projecting into the keyway 22. As can be seen from the Figures, the lock 10 is depicted prior to the insertion of any key, and thus the drivers 50 and tumblers 52 of the lock 10 are disposed in the vertical apertures 48, and the radial tumblers 30, 32 are positioned relative to the sidebar 78, such that the plug 16 is unable to be rotated within the housing 12 of the lock 10.

Figure 3B:
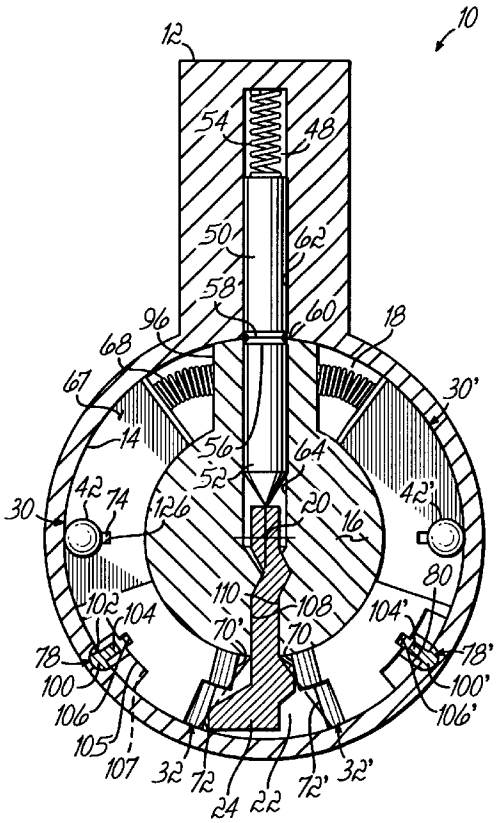
FIG. 3B is a cross-sectional view taken along line 3B—3B of FIG. 3A.
Figure 3A:
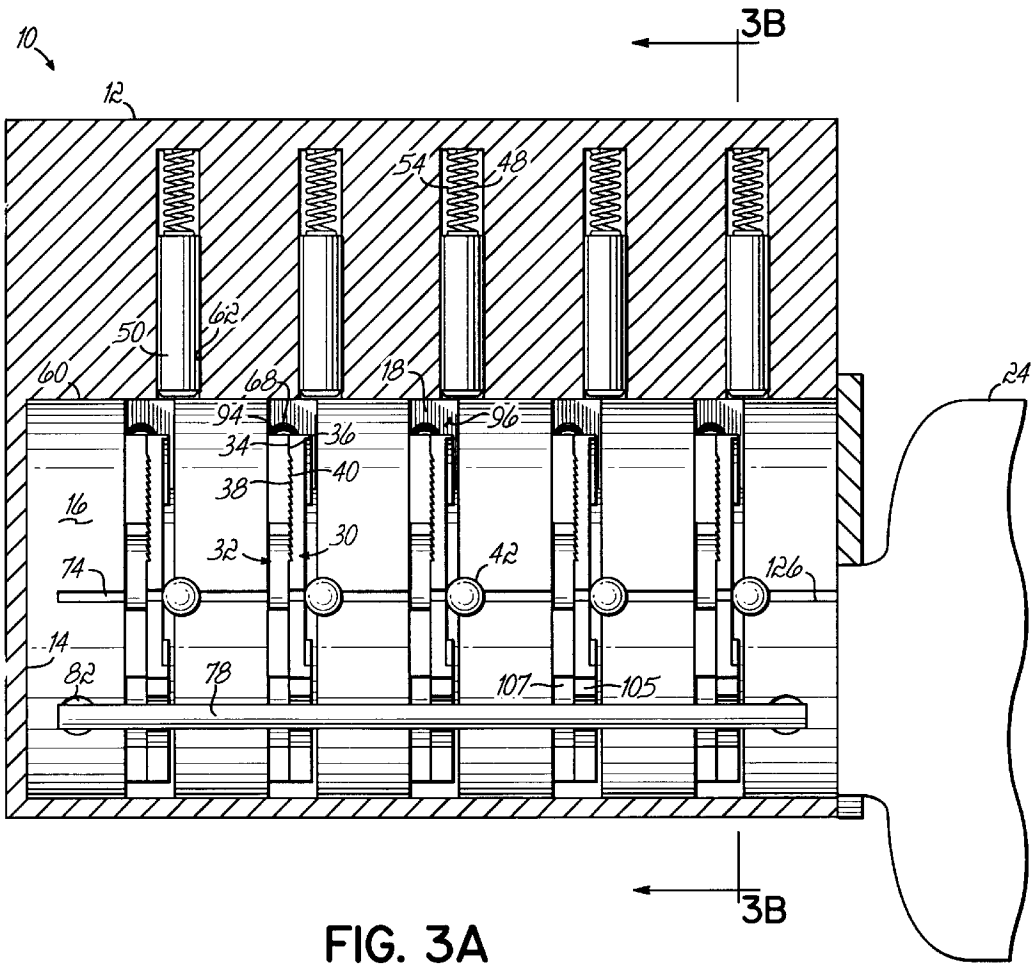
FIG. 3A is a cross-sectional view of the plug of the lock assembly of the present invention depicting the positioning of the radial tumblers and retainers when a first key is inserted into the keyway in accordance with the principles of the present invention.

Referring now to FIGS. 3A and 3B, the lock 10 of the present invention is depicted with a proper first key 24 inserted into the keyway 22 of the lock 10. Due to the key 24 having a proper top edge contour 28, the drivers 50 and tumblers 52 are lifted along the top edge contour 28 such that the point of confrontation between respective sets of drivers 50 and tumblers 52 rests against the shear line 60 of the lock 10. Also with the lock 10 in this position, the first and second radial tumblers 30, 32 have been positioned such that the lug 104 of the side bar 78 is aligned with the side bar notch 106 in the first radial tumbler 30. In this position, the plug 16 is able to be rotated within the housing 12 of the lock 10. As can be seen, the retainer 42 is disposed in the first position holding the first and second radial tumblers 30, 32 in engagement with one another. The retainer 42 is also radially aligned with the vertical apertures 48.

Figure 4B:
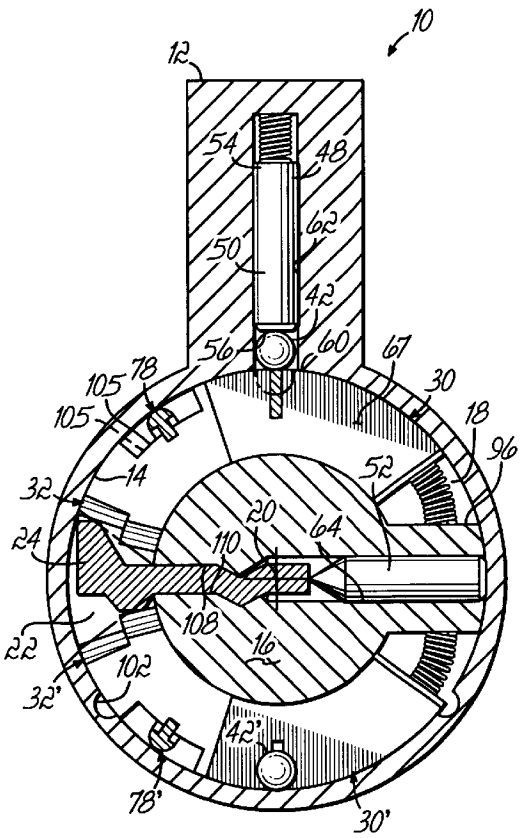
FIG. 4B is a cross-sectional view taken along line 4B—4B of FIG. 4A.
Figure 4A:
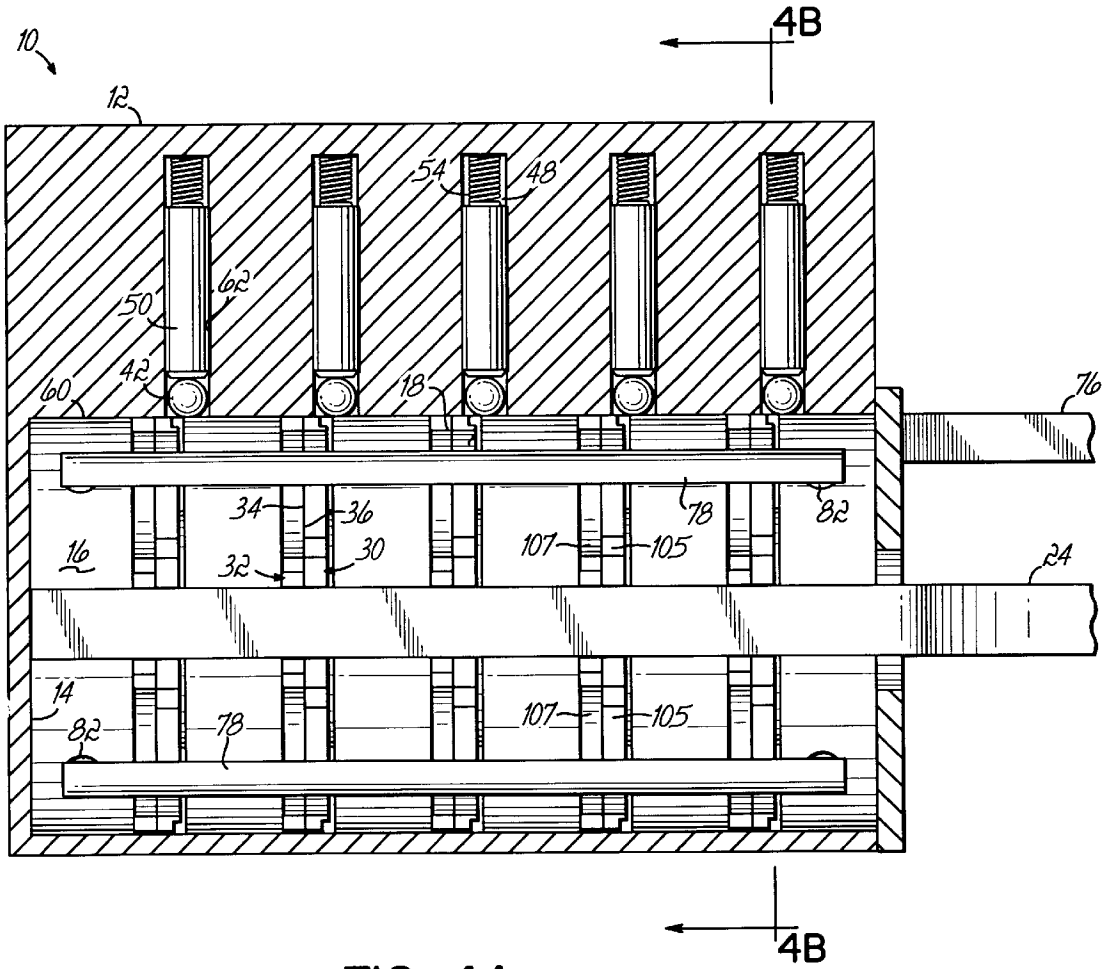
FIG. 4A is a cross-sectional of the plug of the lock assembly of the present invention depicting the first key inserted and rotated one-quarter turn clockwise with a reset tool inserted into a reset slot in accordance with the principles of the present invention.

Referring now to FIGS. 4A and 4B, the lock 10 of the present invention is depicted with a proper first key 24 inserted into the keyway 22 and the plug 16 rotated one-quarter turn. As the plug 16 is rotated one-quarter turn, the forces of rotation cause the sidebar 78 to cam out of the second groove 102 in the housing 12 of the lock 10 and rotate within the housing 12. Also at this point, the drivers 50 are wholly retained within the first portion 62 of each vertical aperture 48 and the tumblers 52 are wholly retained within the second portion 64 of each vertical aperture 48. In order to change the lock 10 to be reprogrammed for a separate second key 44 after the plug 16 has been rotated one-quarter turn, a reset tool 76 is inserted into the longitudinal reset slot 74. As can be seen, this reset tool 76 displaces the retainers 42 out of the cavity and into each vertical aperture 48 of the lock 10. As this happens, the first radial tumbler 30 is captured by the reset tool 76 inserting through the capture notch 126 while the second radial tumbler 32 disengages from the first radial tumbler 30.

Figure 5B:
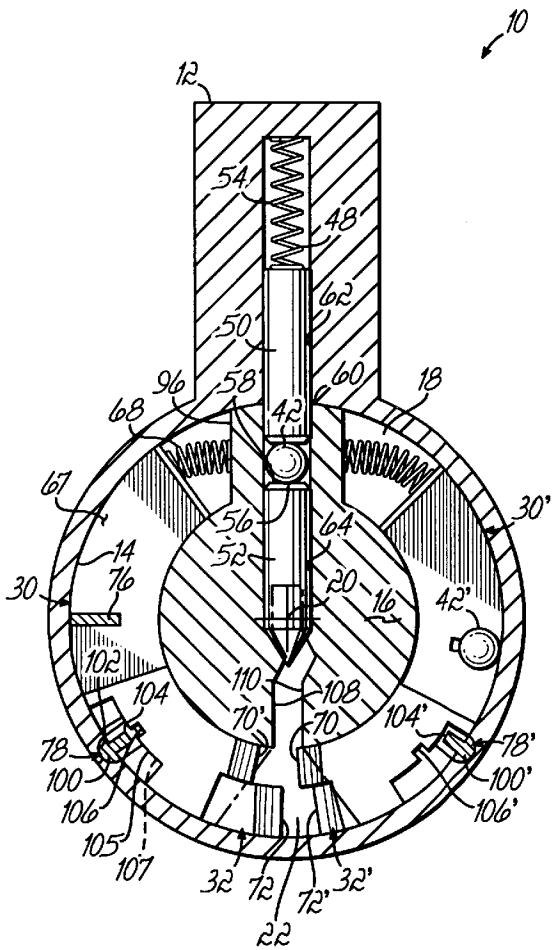
FIG. 5B is a cross-sectional view taken along line 5B—5B of FIG. 5A.
Figure 5A:
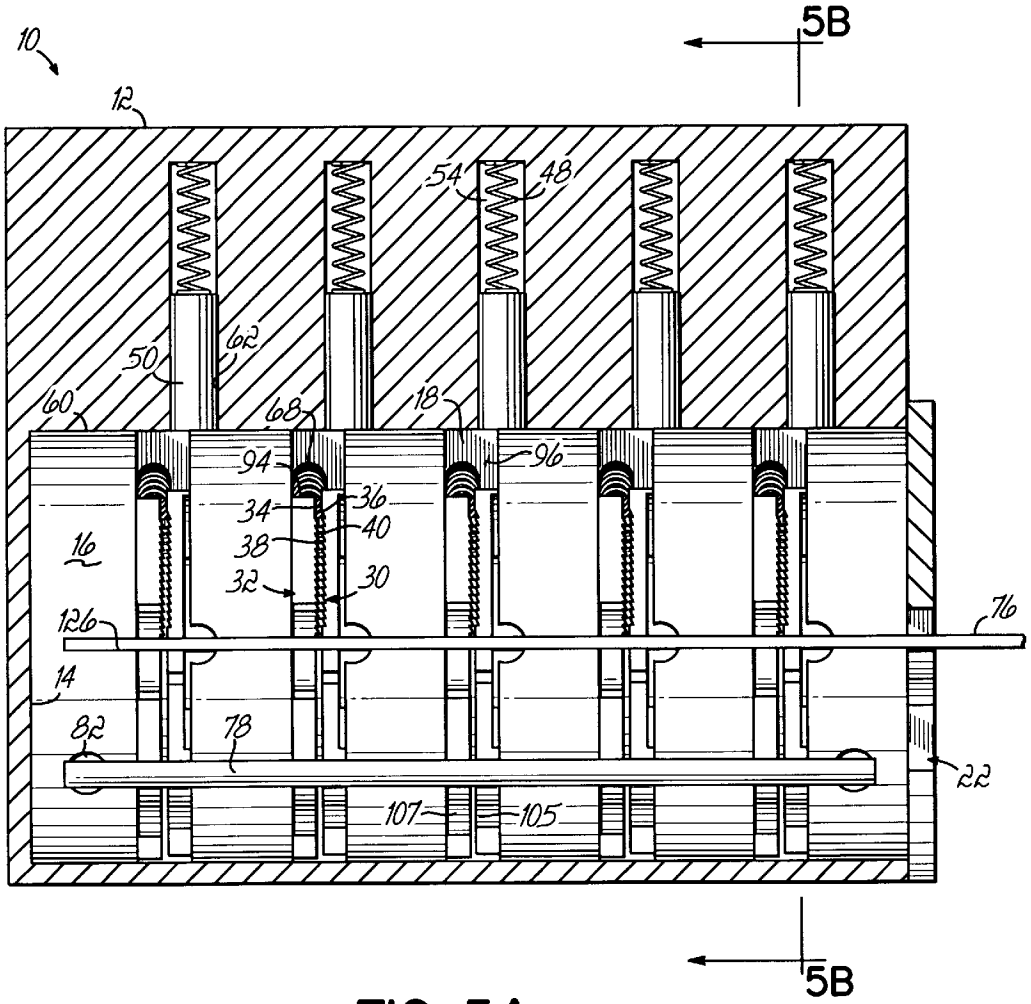
FIG. 5A is a cross-sectional view of the plug of the lock assembly of the present invention showing the plug rotated back to an originating position with the first key removed and the reset tool still inserted in the reset slot in accordance with the principles of the present invention.

With respect to FIGS. 5A and 5B, the lock 10 of the present invention is depicted with the plug 16 having been rotated back to its original position and with the first key 24 removed. However, the reset tool 76 is still inserted in the longitudinal reset slot 74. The retainers 42 are still captured in the vertical apertures 48 and are now located between the drivers 50 and tumblers 52 of the lock 10. Also, the first radial tumbler 30 remains captured in a fixed position relative to the plug 16. In this configuration, the second radial tumbler 32 is able to move independently of the first radial tumbler 30 and can be seen as being biased by the radial tumbler spring 68 into the keyway 22 of the lock 10.

Figure 6B:
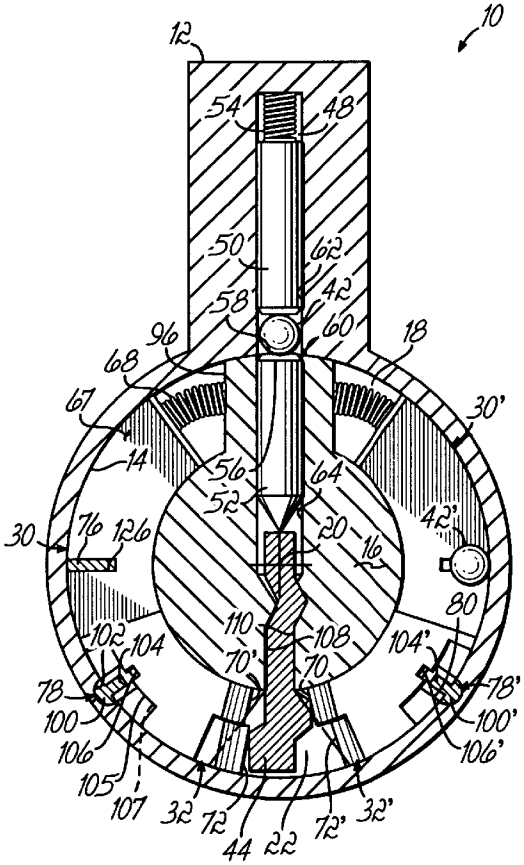
FIG. 6B is a cross-sectional view taken along lines 6B—6B of FIG. 6A.
Figure 6A:
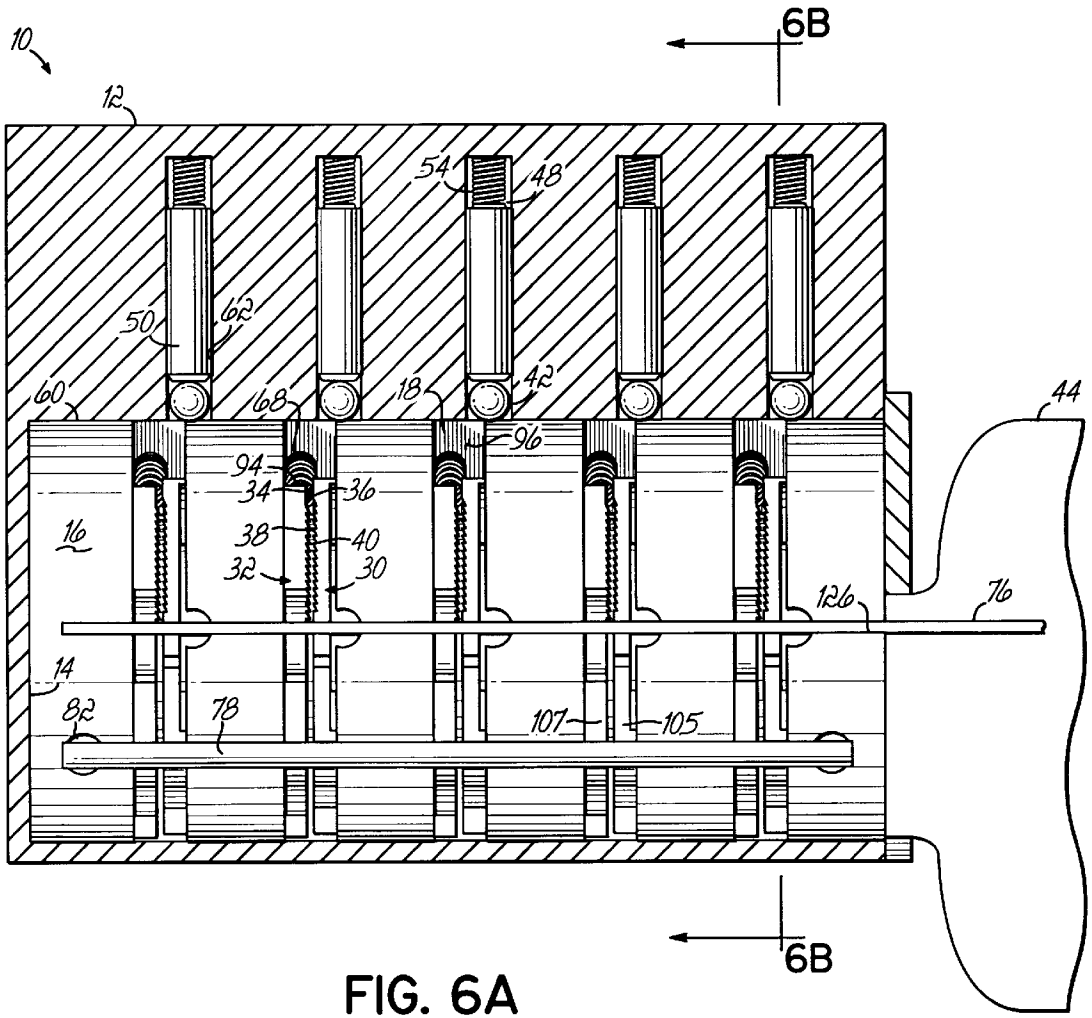
FIG. 6A is a cross-sectional view of the plug of the lock assembly of the present invention showing a second key inserted into the keyway and the reset tool remaining inserted in the reset slot in accordance with the principles of the present invention.

With respect to FIGS. 6A and 6B, the lock 10 of the present invention is shown with a second key 44 (see FIGS. 15A–15C) for which the lock 10 will be reprogrammed inserted into the keyway 22 of the plug 16. This second key 44 contains a top edge contour 28 (see FIGS. 15A–15C) identical to the first key 24 which raises the drivers 50 and tumblers 52 such that the upper edge of each tumbler 52 is located against the shear line 60 of the lock 10. At this time the second radial tumbler 32 can move independently of the first radial tumbler 30, and the retainers 42 are still disposed in between the respective drivers 50 and tumblers 52 of the lock 10. Since the second radial tumbler 32 can move independently of the first radial tumbler 30, it reconfigures to match the longitudinal contour 46 along the second key 44 which has been inserted into the lock 10. Once again, the lug 104 of the sidebar 78 is aligned with the sidebar notch 106 of the first and second radial tumblers 30, 32.

Figure 7B:
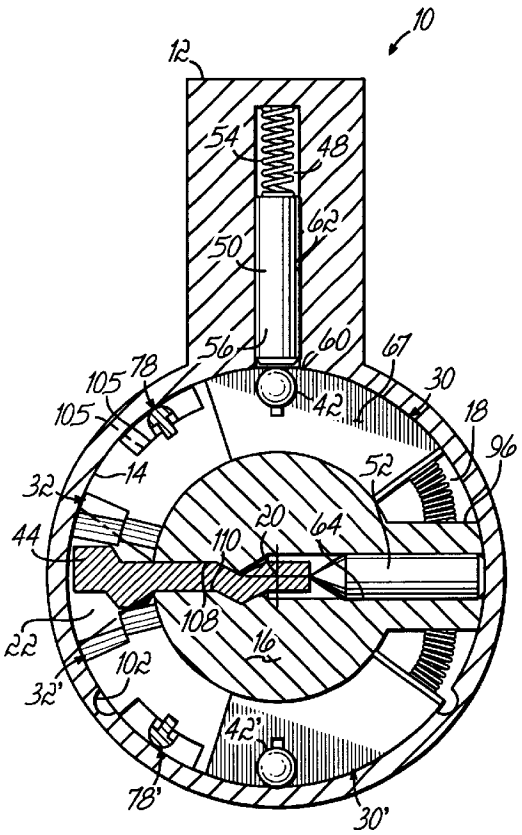
FIG. 7B is a cross-sectional view taken along line 7B—7B of FIG. 7A.
Figure 7A:
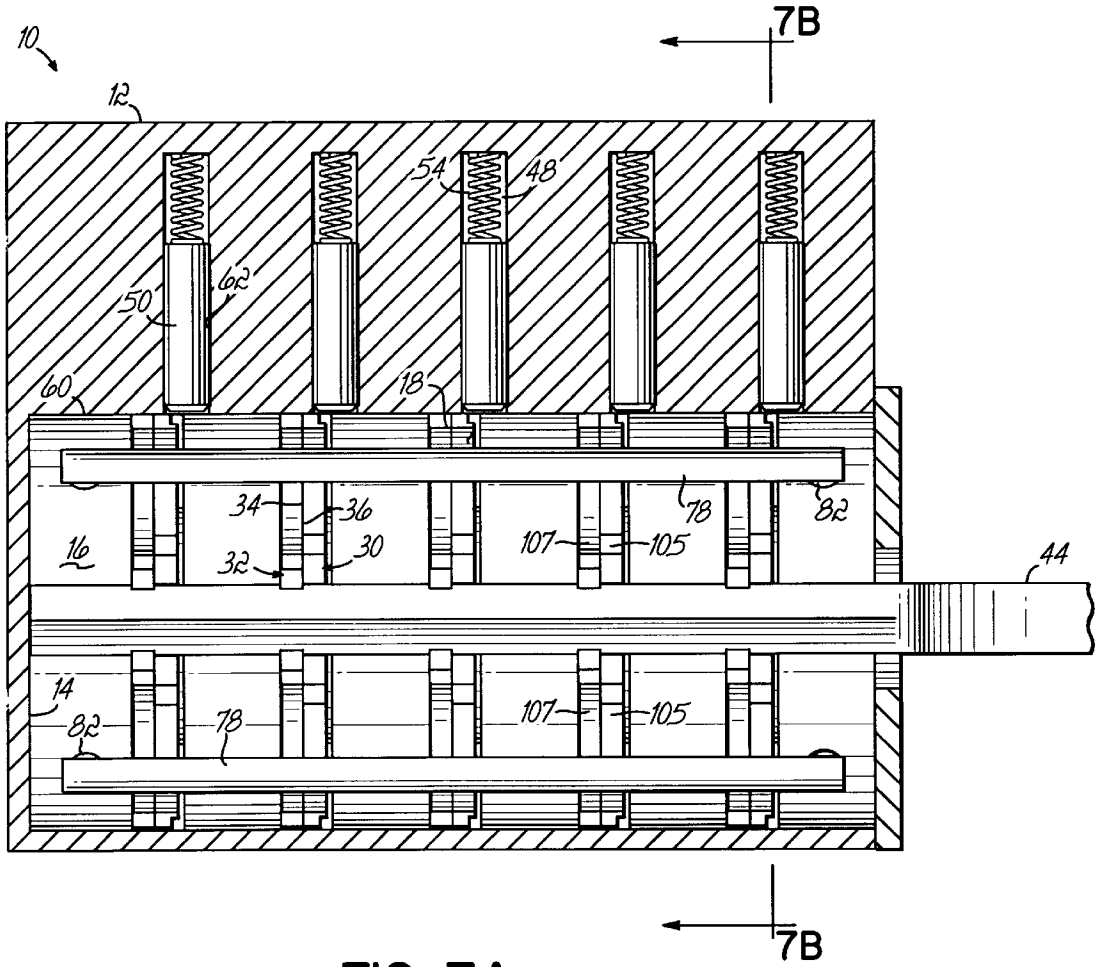
FIG. 7A is a cross-sectional view of the plug of the lock assembly of the present invention showing the second key inserted in the plug rotated one-quarter turn with the reset tool now removed from the reset slot in accordance with the principles of the present invention.

With respect to FIGS. 7A and 7B, the plug 16 containing the newly inserted second key 44 is rotated one-quarter turn and the reset tool 76 is depicted as having been removed from the reset slot 74. As this happens, the retainers 42 which have been held in the vertical apertures 48 are pushed by the spring force of driver springs 54 and the drivers 50 back down into the cavity and confront the first radial tumbler 30. This causes the first radial tumbler 30 to again move toward the second radial tumbler 32 and engage the second radial tumbler 32 such that the first and second radial tumblers 30, 32 will now move cooperatively with each other. This locks the first and second radial tumblers 30, 32 in engagement with one another in a position that matches the longitudinal contour 46 of the second key 44 which is still inserted in the keyway 22 of the lock 10.

Figure 8B:
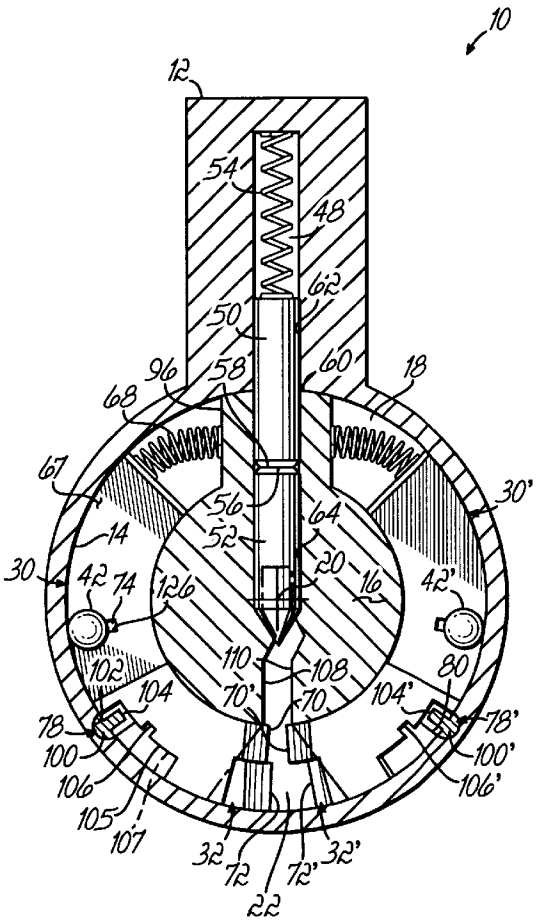
FIG. 8B is a cross-sectional view taken along line 8B—8B of FIG. 8A.
Figure 8A:
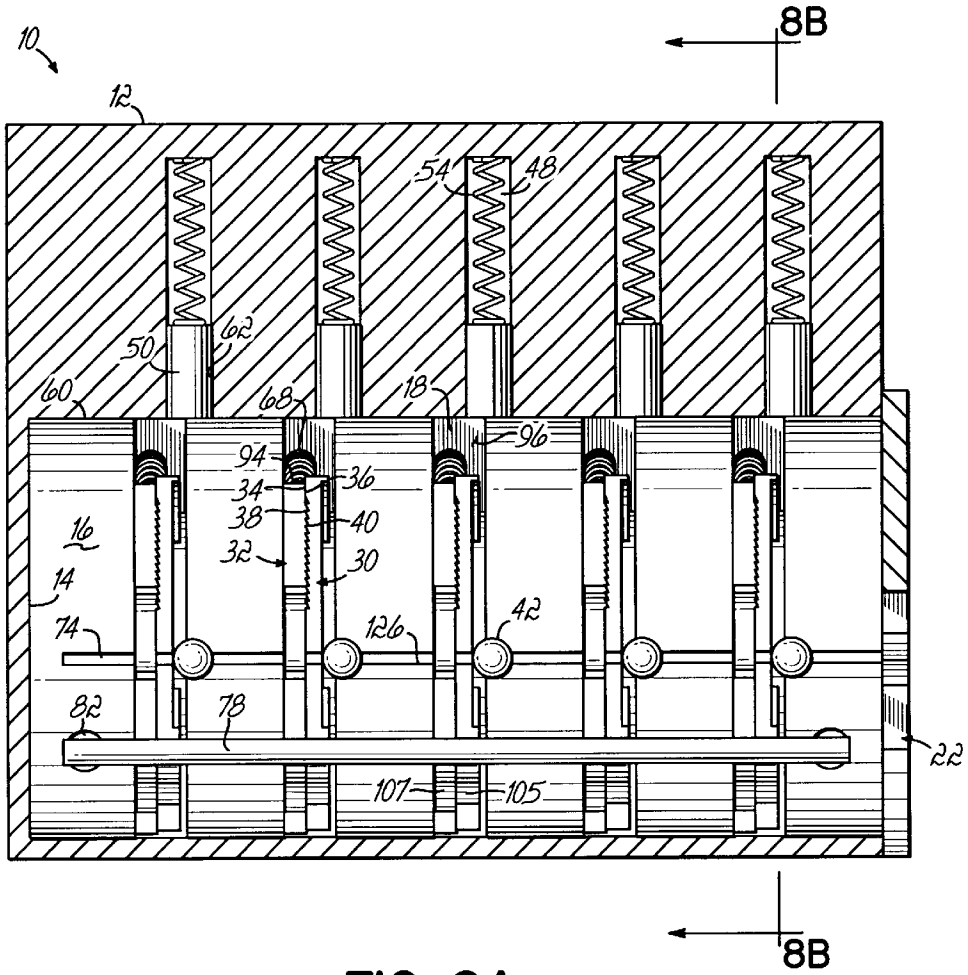
FIG. 8A is a cross-sectional view of the plug of the lock assembly of the present invention showing the plug rotated to its original position and the second key removed with the radial tumblers now held in a new configuration in accordance with the principles of the present invention.

Now with respect to FIGS. 8A and 8B, the lock 10 is shown as having been rotated back to its original position with the second key 44 removed. The retainers 42 now abut each of the first radial tumblers 30 to hold the first and second radial tumblers 30, 32 in engagement in a second position which conforms to the longitudinal contour 46 on the second key 44. Thus, the first and second radial tumblers 30, 32 have been reprogrammed such that the lock 10 will now only accept keys having a longitudinal contour 46 which matches that of the proper second key 44.

Referring now to FIGS. 11A, 11B, 13A–13C, 16A–16C, and 18, the lock of the present invention, in an alternate embodiment, may include an antitamper pin 120 as described above. In order to reprogram the lock 10 of the present invention of this alternate embodiment, the lock 10 requires the use of a first key 24' including an anti-tamper groove 124 to be inserted into the keyway of the lock 10. This allows a reset tool 76 to be inserted into the longitudinal reset slot 74. As this occurs, the reset tool 76 forces the antitamper pin 120 to move from the position blocking the reset slot 74 to a second position which does not impede the reset slot 76. Upon this lateral movement of the anti-tamper pin 120, a second end of the anti-tamper pin 120 insinuates into the anti-tamper groove 124 of the key 24'. The actual mechanism of the reconfiguration of the radial tumblers 30, 32 then proceeds as described above with reference to FIGS. 2A–8B to reset the lock for a second key 44' having a different longitudinal contour 46'.

Figure 12C:
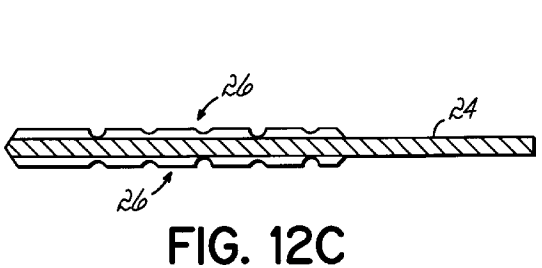
FIG. 12C is a cross-sectional view of the first key taken along line 12C—12C of FIG. 12A.
Figure 12B:
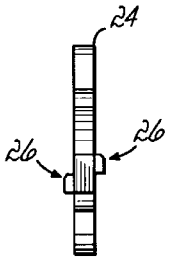
FIG. 12B is an end view of the first key of FIG. 12A.
Figure 12A:
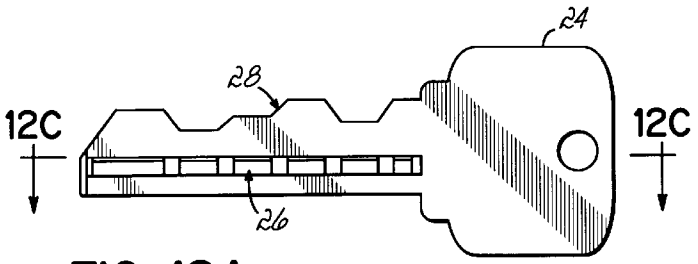
FIG. 12A is a perspective side view of a first key to operate the lock assembly of the present invention depicting a longitudinal contour to correspond to the radial tumblers of the lock assembly of the present invention.

With reference to FIGS. 2A–11B, 13A–13C, 16A–16C, and 18, to reprogram a first alternate embodiment of lock 10, the first key 24', which is the proper key to originally operate the lock 10, is inserted to the keyway 22, and the plug 16 is rotated relative to the housing 12 until an indicator mark 116 on the face of the plug 16 is aligned with an indicator mark 98 on the face of the housing 12 (FIG. 1). In this alternate embodiment, this key 24' includes an antitamper groove 124 running parallel to its longitudinal axis. Lining up the indicator marks 98, 116 ensures that the retainers 42 are disposed along the vertical axis of the vertical apertures 48. The reset tool 76 is then inserted into the reset slot 74. As this happens, the blade portion 114 of the reset tool 76 confronts a first tapered end on the anti-tamper pin 120, and forces it to move laterally along a plane perpendicular to the longitudinal axis 20 of the plug 16, from the first position to the second position. This movement is possible because a second end of the anti-tamper pin insinuates into the anti-tamper groove 124 of the key 24'. If the key 24' did not include an anti-tamper groove 124, the end of the anti-tamper pin 120 would abut the side of the key 24' (such as, for example, a key 24 as is shown in FIG. 12A), thereby preventing movement of the anti-tamper pin 120, and simultaneously preventing the insertion of the reset tool 76 or other object into the reset slot 74. With a proper key 24' having an anti-tamper groove 124 inserted, when the reset tool 76 is inserted into the reset slot 74, it lifts each retainer 42 away from the radial tumblers 30, 32 and into each vertical aperture 48 in the housing 12 of the lock 10 above the plug 16. As this happens, the first radial tumbler 30 disengages from the second radial tumbler 32 such that the second radial tumbler 32 may move independently of the first radial tumbler 30.

Figure 16C:
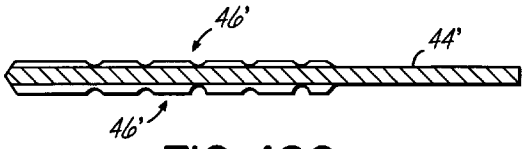
FIG. 16C is a cross-sectional view of the second tenant change key taken along line 16C, 16C of FIG. 16A.
Figure 16B:
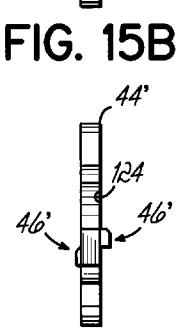
FIG. 16B is an end view of the second tenant change key of FIG. 16A.
Figure 16A:
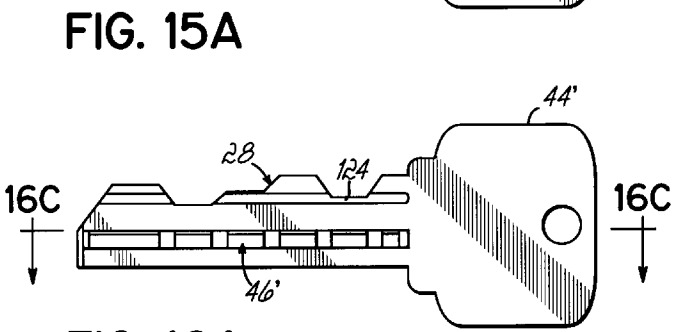
FIG. 16A is a perspective side view of a second tenant change key to operate the lock assembly of the present invention depicting a longitudinal contour to reset the radial tumblers of the lock assembly of the present invention and also depicting an anti-tamper groove.
Figure 17C:
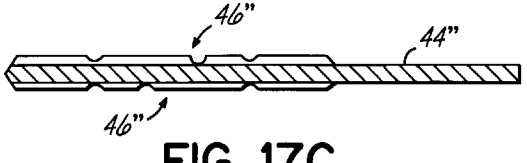
FIG. 17C is a cross-sectional view of the second master change key taken along line 17C—17C of FIG. 17A.
Figure 17B:
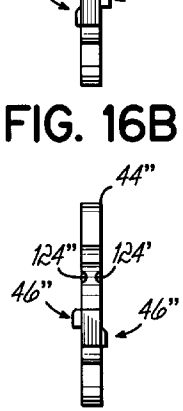
FIG. 17B is an end view of the second master change key of FIG. 17A.
Figure 17A:
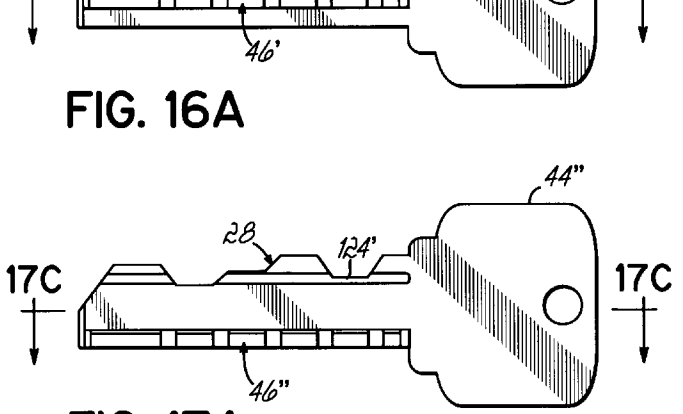
FIG. 17A is a perspective side view of a second master change key to operate the lock assembly of the present invention depicting a longitudinal contour to reset the radial tumblers of the lock assembly of the present invention and also depicting an anti-tamper groove.

In the illustrated embodiment of the present invention, the first radial tumbler 30 is held in a fixed position relative to the plug 16 due to a capture notch 126 disposed in the first radial tumbler 30. When the proper key 24' is inserted in the keyway 22, the capture notch 126 is aligned with the reset slot 74. Thus, when the reset tool 76 is inserted, it passes through the capture notch 126, thereby holding the first radial tumbler 30 in a fixed location as the second radial tumbler 32 moves relative to the first radial tumbler 30. The plug 16 is then rotated back to the starting position and the first key 24' removed from the keyway 22. As this happens, the radial tumbler spring 68 forces the second tumbler 32 toward the keyway 22 while the first radial tumbler 30 is captured. The remainder of the process for reprogramming the lock 10 is the same as that described previously with respect to FIGS. 2A–8B and the keys of FIGS. 12A–12C and 15A–15C, although it will be recognized by those skilled in the art that the second key 44' will also include an anti-tamper groove 124, as shown in FIGS. 16A–16C.

In the illustrated embodiment described above with respect to FIGS. 2A–8B, and in the alternate embodiment described with respect to FIGS. 11A and 11B, the lock 10 of the present invention has been described with respect to reprogramming the lock 10 to accept a new tenant key having a longitudinal contour different than that of an original tenant key. In another alternate embodiment, the lock 10 may be reprogrammed to accept a different master key by following the procedure disclosed above while reconfiguring the pairs of radial tumblers 30', 32' disposed on the opposite side of the plug 16 from the first and second radial tumblers 30, 32. In general, this would occur by rotating the plug 16 shown in the Figures in a counter-clockwise direction, as opposed to the clockwise direction depicted in the Figures for changing a tenant key. However, the general method of reconfiguring the first and second master radial tumblers 30', 32' would remain the same.

Referring now to FIGS. 2A–8B, 14A–14C, 17A–17C, and 18, in use the lock 10 of the present invention which accepts a first master key 24" may be reprogrammed to accept a second master key 44" as follows. With particular reference to FIGS. 2A and 2B, the lock 10 of the present invention is shown with the retaining member 42' contacting and confronting the first radial tumbler 30', and the first and second radial tumblers 30', 32' being held in engagement with one another. This engagement is caused by the meshing of the series of first and second teeth (not shown). The distal ends 70', 72' of both the first and second radial tumblers 30', 32' thus project into the keyway 22 in a first predetermined position to accept a first master key 24" having longitudinal contour 26" which matches the pattern defined by the distal ends 70', 72' projecting into the keyway 22. As can be seen from the Figures, the lock 10 is depicted prior to the insertion of any key, and thus the drivers 50 and tumblers 52 of the lock 10 are disposed in the vertical apertures 48, and the radial tumblers 30', 32' are positioned relative to the sidebar 78', such that the plug 16 is unable to be turned within the housing 12 of the lock 10.

With a proper first master key 24", inserted into the keyway 22 of the lock 10, the first and second radial tumblers 30', 32' are positioned such that the lug 104' of the side bar 78' is aligned with the side bar notch 106' in the first radial tumbler 30'. In this position, the lock 10 is able to be rotated. The retainer 42' will then be disposed in the cavity holding the first and second radial tumblers 30', 32' in engagement with one another. The retainer 42' is also radially aligned with the vertical apertures 48.

With a proper first master key 24" inserted into the keyway 22 and the plug 16 rotated one-quarter turn counter-clockwise (not shown in the Figs.), the forces of rotation cause the sidebar 78' to cam out of the second groove 102' in the housing 12 of the lock 10 and rotate with the lock 10 inside the plug 16. Also at this point, the drivers 50 are wholly retained within the first portion 62 of each vertical aperture 48 and the tumblers 52 are wholly retained within the second portion 64 of each vertical aperture 48. In order to change the lock 10 to be reprogrammed for a separate second master key 44", after the plug 16 has been rotated one-quarter turn, a reset tool (see FIG. 18) is inserted into the longitudinal reset slot 74'. This reset tool displaces the retainers 42' out of their respective cavities and into each vertical aperture 48 of the lock 10. As this happens, the first radial tumbler 30' is captured by the reset tool inserting through the capture notch 126' while the second radial tumbler 32' disengages from the first radial tumbler 30'.

With the plug 16 rotated back to its original position and with the first master key 24" removed, the reset tool still inserted in the longitudinal reset slot 74', the retainers 42' are still captured in the vertical apertures 48 and are now located between the drivers 50 and tumblers 52 of the lock 10. Also, the first radial tumbler 30' remains captured in a fixed position relative to the plug 16. In this configuration, the second radial tumbler 32' is able to move independently of the first radial tumbler 30' and can be seen as being biased by the spring all the way into the keyway 22 of the lock 10.

With a second master key 44" for which the lock 10 will be reprogrammed inserted into the keyway 22 of the plug 16, the second radial tumbler 32' can move independently of the first radial tumbler 30', and the retainers 42' are still disposed in between the respective drivers 50 and tumblers 52 of the lock 10. Since the second radial tumbler 32' can move independently of the first radial tumbler 30', it individually reconfigures to match the longitudinal contour 46" along the second master key 44" which has been inserted into the lock 10. Once again, the lug 104' of the sidebar 78' is aligned with the sidebar notch 106' of the first and second radial tumblers 30', 32'.

The plug 16 containing the newly inserted second master key 44" is then rotated one-quarter turn and the reset tool is removed from the reset slot 74'. As this happens, the retainers 42' which have been held in the vertical apertures 48 are pushed by the spring force of driver springs 54 and the drivers 50 back down into the cavity and confront the first radial tumbler 30'. This causes the first radial tumbler 30' to again move toward the second radial tumbler 32' and engage the second radial tumbler 32' such that the first and second radial tumblers 30', 32' will now move cooperatively with each other. This locks the first and second radial tumblers 30', 32' in engagement with one another in a position that matches the longitudinal contour 46" of the second master key 44", which is still inserted in the lock 10.

With the lock 10 rotated back to its original position with the second master key 44" removed, the retainers 42' now abut each of the first radial tumblers 30' to hold the first and second radial tumblers 30', 32' in engagement in a second position which conforms to the longitudinal contour 46" on the second master key 44". Thus, the first and second radial tumblers 30', 32' have been reprogrammed such that the lock 10 will now only accept master keys having a longitudinal contour 46" which matches that of the proper second master key 44".

As described previously with respect to reprogramming the lock 10 to accept different tenant keys, the lock 10 for reprogramming for master keys may also include an anti-tamper pin 120' disposed in the plug and an anti-tamper groove 124' on the first and second master keys 24", 44" (see FIGS. 14A–14C and 17A–17C). It will be further appreciated by those having skill in the art that tenants of a particular facility may be provided with a key not including an anti-tamper groove while only authorized persons retain possession of a key including an anti-tamper groove. Thus, only authorized persons would be able to reprogram the lock.

While the invention has been disclosed by reference to the details of preferred embodiments of the invention, it is to be understood that the disclosure is intended in an illustrative rather than in a limiting sense, as it is contemplated that modifications will readily occur to those skilled in the art, within the spirit of the invention and the scope of the appended claims.

What is claimed is:

1. An adaptable lock assembly comprising:

a housing having a bore therein;

a plug rotatably mounted in said bore, said plug having a longitudinal axis and a first groove disposed, in said plug concentrically about and radially outwardly from said longitudinal axis, said plug further including a first orifice parallel to said longitudinal axis, said first orifice adapted to receive a key; and a first radial tumbler and a second radial tumbler disposed in said first groove for circumferential motion about said longitudinal axis in said first groove, said first and second radial tumblers having axially adjacent complementary faces, said first radial tumbler and said second radial tumbler adapted to be disposed in said first groove with said complementary faces in an engaged position or a disengaged position relative to each other.

2. The lock of claim 1 further comprising a retainer disposed in said lock, said retainer adapted to be disposed in said lock in a first position or a second position, wherein said retainer when disposed in said lock in said first position confronts said first radial tumbler such that said first radial tumbler and said second radial tumbler are in said engaged position.

3. The lock of claim 2 wherein said retainer, when disposed in said lock in said second position, does not confront said first radial tumbler and said first radial tumbler and said second radial tumbler are in said disengaged position.

4. The lock of claim 1, further including a spring in confronting relationship with at least one of said first radial tumbler and said second radial tumbler, wherein said spring biases at least one of said first radial tumbler and said second radial tumbler such that a distal end of said first radial tumbler and a distal end of said second radial tumbler extend into said first orifice.

5. The lock of claim 4, wherein said first radial tumbler includes a notch disposed through a portion of said first radial tumbler and said second radial tumbler includes a notch disposed through a portion of said second radial tumbler.

6. The lock of claim 5, further including a movable side bar disposed in a side bar cavity in said lock, said side bar having a proximal end and a distal end, said proximal end adapted to insert into said notch in said first radial tumbler and said notch in said second radial tumbler, and said distal end adapted to confront a second groove disposed in said housing of said lock.

7. The lock of claim 2, wherein said plug further includes a second orifice disposed in said plug, said second orifice intersecting a cavity, said cavity adapted to receive said retainer, said second orifice adapted to receive a reset tool.

8. The lock of claim 7, wherein said retainer is disposed in said lock in said first position and said first radial tumbler and said second radial tumbler are in said engaged position when said reset tool and said second orifice are not in receiving relationship.

9. The lock of claim 7, wherein said retainer is disposed in said lock in said second position and said first radial tumbler and said second radial tumbler are in said disengaged position when said reset tool and said second orifice are in receiving relationship.

10. The lock of claim 7, further comprising a movable pin disposed within the plug, at least a portion of the pin disposed such that it intersects with and extends into said second orifice when said pin is in a first pin position.

11. The lock of claim 10, wherein said pin is adapted for translatory movement along a plane perpendicular to the axis of said plug to a second pin position, wherein said pin is disposed such that it does not intersect with and extend into said second orifice.

12. An adaptable lock assembly comprising:

a housing having a bore therein;

a cylindrical plug rotatably mounted in said bore, said plug having a longitudinal axis and a first groove disposed in the circumference of said plug circumferentially about said longitudinal axis, said plug further including a first orifice parallel to said longitudinal axis, said first orifice adapted to receive a key; and a first radial tumbler and a second radial tumbler disposed in said first groove for circumferential motion about said longitudinal axis in said first groove, said first radial tumbler and second radial tumbler adapted to be disposed in said first groove in an engaged position or a disengaged position relative to each other, wherein a distal end of at least one of said first radial tumbler and second radial tumbler extends into said first orifice to engage said received key; wherein said first radial tumbler and second radial tumbler are movable between said engaged position and said disengaged position without removal of said plug from said housing.

13. The lock of claim 12 further comprising a retainer disposed in said lock, said retainer adapted to be disposed in said lock in a first position or a second position, wherein said retainer when disposed in said first position confronts said first radial tumbler such that said first radial tumbler, and said second radial tumbler are in said engaged position, and wherein said retainer, when disposed in said lock in said second position, does not confront said first radial tumbler, such that said first radial tumbler and said second radial tumbler are in said disengaged position.

14. The lock of claim 12, further comprising a spring in confronting relationship with at least one of said first tumbler and said second radial tumbler, for biasing said distal end into said first orifice.

15. The lock of claim 12 wherein said first radial tumbler includes a notch disposed through a portion of said first radial tumbler, said second radial tumbler includes a notch disposed through a portion of said second radial tumbler, and wherein said lock further comprises a movable side bar disposed in a side bar cavity in said plug, said side bar having a proximal end and a distal end, said proximal end adapted to insert into said notch in said first radial tumbler and said notch in said second radial tumbler, and said distal end adapted to confront a second groove disposed in said housing of said lock.

16. The lock of claim 13, wherein said plug further has a second orifice disposed therein, said second orifice intersecting a cavity, said cavity adapted to receive said retainer, and said second orifice adapted to receive a reset tool, wherein said retainer is disposed in said first position and said first radial tumbler and said second tumbler are in said engaged position when said reset tool and said second orifice are not in receiving relationship, and wherein said retainer is disposed in said second position and said first radial tumbler and said second tumbler are in said disengaged position when said reset tool and said second orifice are in receiving relationship.

17. The lock of claim 16, further comprising a movable pin disposed within the plug, at least a portion of the pin disposed such that it intersects with and extends into said second orifice when said pin is in a first position, wherein said pin is adapted for translatory movement along a plane perpendicular to the axis of said plug to a second pin position, wherein said pin is disposed such that it does not intersect with and extend into said second orifice.

18. An adaptable lock assembly comprising:

a housing having a bore therein;

a plug rotatably mounted in said bore, said plug having:

a longitudinal axis and a first groove disposed cirumferentially about and radially outwardly from said longitudinal axis, a first orifice parallel to said longitudinal axis, that is adapted to receive a key, a retainer cavity, and a second orifice that intersects the retainer cavity, and adapted to receive a reset tool;

a first radial tumbler and a second radial tumbler disposed in said first groove for circumferential motion about said longitudinal axis in said first groove, said first radial tumbler and said second radial tumbler adapted to be disposed in said first grove in an engaged position or a disengaged position relative to each other;

a retainer adapted to be diposed in said plug ina first position or a second position within the retainer cavity, wherein said retainer when disposed in said first position confronts said first radial tumbler such that said first radial tumbler and said second radial tumbler are in said engaged position, and wherein said retainer when disposed in said second position, does not confront said first radial tumbler, such that said first radial tumbler and said second radial tumbler are in said disengaged position.

19. The lock of claim 18 further comprising a spring in confronting relationship with at least one of said first radial tumbler and said second radial tumbler, wherein said spring biases at least one of said first radial tumbler and said second radial tumbler such that at least one of a distal end of said first radial tumbler and a distal end of said second radial tumbler extends into said first orifice.

20. The lock of claim 18 wherein said first radial tumbler includes a notch disposed through a portion of said first radial tumbler, said second radial tumbler includes a notch disposed through a portion of said second radial tumbler, and wherein said lock further comprises a movable side bar disposed in a side bar cavity in said plug, said side bar having a proximal end and a distal end, said proximal end adapted to insert into said notch in said first radial tumbler and said notch in said second radial tumbler, and said distal end adapted to confront a second groove disposed in said housing of said lock.

21. The lock of claim 18 wherein said retainer is disposed in said first position and said first radial tumbler and said second tumbler are in said engaged position when said reset tool and said second orifice are not in receiving relationship, and wherein said retainer is disposed in said second position and said first radial tumbler and said second tumbler are in said disengaged position when said reset tool and said second orifice are in receiving relationship.

22. The lock of claim 21, further comprising a movable pin disposed within the plug, at least a portion of the pin disposed such that it intersects with and extends into said second orifice when said pin is in a first position, and wherein said pin is adapted for trasnslatory movement along a plane perpendicular to the axis of said plug to a second pin position, wherein said pin is disposed such that it does not intersect with and extend into said second orifice.

23. A method for reprogramming a lock which accepts and is operated by a first key, such that subsequent to reprogramming, the lock will not accept the first key but will accept and be operated by a second key, the method comprising the following steps made without disassembling the lock:

providing an adaptable lock assembly comprising a housing having a bore therein, a plug rotatably mounted in the bore, the plug having a longitudinal axis and a first groove disposed in the plug concentrically about and radially outwardly from the longitudinal axis, the plug further including a first orifice parallel to the longitudinal axis, the first orifice adapted to receive a key, and a first radial tumbler and a second radial tumbler disposed for circumferential motion about the longitudinal axis in the first groove, the first radial tumbler and the second radial tumbler adapted to be disposed in the first groove in an engaged position or a disengaged position relative to each other;

providing a first key which configured to operate the lock, and a second key, each of the first key and the second key including a longitudinal contour of outwardly-projecting ridges and grooves, the second key having a different longitudinal contour of outwardly-projecting ridges and grooves than the first key;

inserting the first key into the first orifice;

placing the first radial tumbler and the second radial tumbler in the disengaged position;

removing the first key from the first orifice;

inserting the second key into the first orifice; and placing the first radial tumbler and the second radial tumbler in said engaged position.

24. The method of claim 23, wherein the lock further includes a retainer disposed in the lock, the retainer adapted to be disposed in the lock in a first position or a second position, wherein placing the first radial tumbler and the second radial tumbler in the disengaged position includes moving the retainer from the first position to the second position.

25. The method of claim 23, wherein the lock further includes a retainer disposed in the lock, the retainer adapted to be disposed in the lock in a first position or a second position, wherein placing the first radial tumbler and the second radial tumbler in the engaged position includes moving the retainer from the second position to the first position.

26. The method of claim 23, further comprising providing a reset tool and wherein the lock further includes a retainer movably disposed in the lock, the retainer adapted to be disposed in the lock in a first position or a second position.

27. The method of claim 26, wherein the lock includes a second orifice disposed in the plug, the second orifice adapted to receive the reset tool.

28. The method of claim 27, wherein moving the retainer from the first position to the second position further comprises placing the reset tool and the second orifice in receiving relationship.

29. The method of claim 28, wherein moving the retainer from the second position to the first position further comprises moving the reset tool out of receiving relationship with the second orifice.

* * * * *

UNITED STATES PATENT AND TRADEMARK OFFICE

CERTIFICATE OF CORRECTION

PATENT NO. : 6,776,017 B2
DATED : August 17, 2004
INVENTOR(S) : Rodrick A. Herdman It is certified that error appears in the above-identified patent and that said Letters Patent is hereby corrected as shown below:

Column 17,
Line 18, delete “disposed,”, insert -- disposed --.

Column 18,
Line 29, delete “radial tumbler and second”, insert -- radial tumbler and said second --.
Line 50, delete “said first”, insert -- said first radial --.

Column 19,
Line 12, delete “first position”, insert -- first pin position --.
Line 33, delete “ina”, insert -- in a --.

Signed and Sealed this

Second Day of November, 2004

JON W. DUDAS
*Director of the United States Patent and Trademark Office*